US011186983B2

(12) United States Patent
Patterson et al.

(10) Patent No.: US 11,186,983 B2
(45) Date of Patent: Nov. 30, 2021

(54) PREFABRICATED BUILDING MODULE

(71) Applicant: Lendlease Manufactured Products Pty Limited, Barangaroo (AU)

(72) Inventors: Daryl Patterson, Sydney (AU); Greg Deas, Sydney (AU)

(73) Assignee: LENDLEASE MANUFACTURED PRODUCTS PTY LIMITED, Barangaroo (AU)

( * ) Notice: Subject to any disclaimer, the term of this patent is extended or adjusted under 35 U.S.C. 154(b) by 0 days.

(21) Appl. No.: 16/190,026

(22) Filed: Nov. 13, 2018

(65) Prior Publication Data

US 2019/0186122 A1 Jun. 20, 2019

Related U.S. Application Data

(63) Continuation-in-part of application No. PCT/AU2017/050443, filed on May 15, 2017.

(30) Foreign Application Priority Data

May 13, 2016 (AU) ..... 2016901789

(51) Int. Cl.

| | |
|---|---|
| ***E04B 1/348*** | (2006.01) |
| ***E04B 1/10*** | (2006.01) |
| ***E04H 1/04*** | (2006.01) |
| ***E04B 1/94*** | (2006.01) |
| ***E04B 7/18*** | (2006.01) |
| ***E04C 3/36*** | (2006.01) |

(52) U.S. Cl.

CPC ..... *E04B 1/34838* (2013.01); *E04B 1/10* (2013.01); *E04B 1/34861* (2013.01); *E04B 1/94* (2013.01);

(Continued)

(58) Field of Classification Search

CPC ..... E04B 1/34838; E04B 1/10; E04B 7/18; E04B 1/94; E04B 1/34861; E04B 2001/34892; E04H 1/04; E04C 3/36

See application file for complete search history.

(56) References Cited

U.S. PATENT DOCUMENTS 3,642,339 A * 2/1972 Ruderfer ..... A47B 55/04 312/283
4,118,905 A * 10/1978 Shelley ..... E04B 1/34823 52/236.4

(Continued)

FOREIGN PATENT DOCUMENTS

GB 2524025 9/2015
GB 2524025 A * 9/2015 ..... E04H 1/1205

(Continued)

OTHER PUBLICATIONS

PCT International Search Report from PCT/AU2017/050443 dated Jun. 20, 2017.

(Continued)

*Primary Examiner* — Brian D Mattei
*Assistant Examiner* — Omar F Hijaz
(74) *Attorney, Agent, or Firm* — Ladas & Parry, LLP

(57) ABSTRACT

A prefabricated building module is described. The building module may provide structural stability for a building, including when stacked with like building modules. The building module may provide a service riser for the building. The building module may provide fixtures for the building, including bathroom, kitchen and laundry fixtures. Also described is a building including prefabricated building modules and a method of constructing a building using prefabricated building modules.

15 Claims, 40 Drawing Sheets

(52) U.S. Cl.
CPC ..... *E04B 7/18* (2013.01); *E04C 3/36* (2013.01); *E04H 1/04* (2013.01); *E04B 2001/34892* (2013.01)

(56) References Cited

U.S. PATENT DOCUMENTS

| | | | | |
|---|---|---|---|---|
| 8,875,445 | B2 | 11/2014 | Lippert | |
| 2003/0156501 | A1* | 8/2003 | Spindel | G06Q 10/087 369/1 |
| 2005/0108957 | A1 | 5/2005 | Quesada | |
| 2014/0115976 | A1 | 5/2014 | Lippert | |
| 2014/0123574 | A1 | 5/2014 | Paone | |
| 2015/0240475 | A1* | 8/2015 | Malakauskas | E04H 1/04 52/79.13 |

FOREIGN PATENT DOCUMENTS

| | | | | |
|---|---|---|---|---|
| GB | 2541765 B | * | 7/2019 | B65G 1/0478 |
| WO | 2013/110617 | | 8/2013 | |
| WO | 2013/190498 A1 | | 12/2013 | |

OTHER PUBLICATIONS

PCT International Preliminary Report on Patentability (Chapter 1) from PCT/AU2017/050443 dated Nov. 13, 2018.
Timber Development Association (NSW), "Massive Timber Construction Systems Cross-laminated Timber (CLT)", Technical Design Guide, ISBN 978-1-921763-49-6, published 2013 (24 pages).
Extended European Search Report from European Patent Application No. 17795200.9 dated Jan. 13, 2020.

* cited by examiner

PREFABRICATED BUILDING MODULE

CROSS-REFERENCE TO RELATED APPLICATIONS

The present application is a continuation-in-part of PCT Application No. PCT/AU2017/050443, filed on May 15, 2017, which claims priority to Australian Patent Application No. 2016901789, filed on May 13, 2016, the contents of which are incorporated herein by reference in their entireties.

FIELD

This invention relates to the field of building construction. Certain embodiments relate to a prefabricated building module, a building structure including the building module and a method of constructing a building.

BACKGROUND OF THE INVENTION

Buildings, including large residential and commercial buildings are constructed on-site using labour intensive processes. Component parts are shipped to the building site and used in the construction process, under the guidance of a project team, including builders, electricians, plumbers, carpenters, project managers, site managers, inspectors and many others.

Prefabricated building components have been identified as a way to help increase the efficiency of construction. In general, a prefabricated component is a constructed unit of the building, which is formed off-site and shipped to the building site for inclusion in the building construction as a unitary building component. By constructing the prefabricated component off-site, more efficient techniques for production can be used, for example, taking advantage of increased automation and economies of scale.

There are a number of limitations and trade-offs involved when using prefabricated components. One is a limitation on size; the component must be shipped to the site after it is constructed, typically on public roads, Another is cost of transportation, in that a constructed prefabricated component can sometimes include a significant amount of free space or air within it in comparison to how the component parts of the prefabricated component could be shipped. A further trade-off is additional materials that may be required to provide structural support for the building; a prefabricated component may have to be self-supporting and sufficiently robust to be transported, whereas the equivalent part of an on-site constructed building, may not need these properties, as other structures of the building may provide the necessary support.

In light of these and other limitations and trade-offs involved in using prefabricated components, there is a need for alternative forms of prefabricated components for use for use by the construction industry.

SUMMARY

In one embodiment there is provided a prefabricated building module for a building structure, wherein said building module comprises at least one wall section of cross-laminated timber extending vertically between the upper and lower peripheral edges of the building module, wherein the building module is configured to be securable in a stack of like prefabricated building modules so that one or more resulting, columns of said cross-laminated timber sections act as a loadbearing structure for the building structure.

In one embodiment there is provided a prefabricated building module for a building structure, the building module comprising: a perimeter defining an internal volume; at least one vertically extending service riser for carrying at least one service to the prefabricated building module and to a vertically adjacent like building module; and at least one fixture adapted to provide said at least one service to the building within or at the building module.

In one embodiment there is provided a building structure comprising a plurality of distributed shear load support structures for lateral loads exerted on the building structure, wherein the shear load support structures each comprise a plurality of primary elements arranged so as to form a vertical stack, and wherein each primary element is a prefabricated volumetric building module.

In one embodiment there is provided a building structure comprising a plurality of service risers distributed across the building structure, wherein the service risers are each formed by a plurality of primary elements arranged so as to form a vertical stack, and wherein each primary element is a prefabricated volumetric building module.

In one embodiment there is provided a method of constructing a building structure, the method comprising: installing a first primary element on a first level of the building structure, wherein said first primary element is formed from a prefabricated volumetric module; and constructing a first secondary element around the first primary element on the first level of the building structure, wherein the first primary element forms part of a shear load support structure for lateral loads exerted on the building structure and/or provides part of a service riser for the building structure.

In one embodiment there is provided a method of designing a building structure, the method comprising: selecting at least a first type of primary element from amongst a plurality of different types of primary elements, each type of primary element being formed as a prefabricated volumetric building module; selecting a location for at least one shear load support structure for lateral loads exerted on the building structure, the shear load support structure comprising a plurality of the first type of primary elements arranged so as to form a vertical stack; and selecting a horizontal dimension of at least one secondary element adjacent at least one vertical surface of the shear load support structure, the dimension extending from said vertical surface to a perimeter defining an internal volume of the secondary element, wherein the step of selecting the horizontal dimension is limited by at least one predetermined parameter.

In one embodiment there is provided parts for assembly of a building structure, the parts comprising: a first plurality of stackable prefabricated building modules for forming a first stack of prefabricated building modules; a second plurality of stackable prefabricated building modules for forming a second stack of prefabricated building modules; components, different from the prefabricated building modules, for spanning a first distance between two said stacks of prefabricated building modules; and components, different from the prefabricated building modules, for spanning a second distance between two said stacks of prefabricated building modules, the second distance different from the first distance; wherein the first and second plurality of stackable prefabricated building modules are configured so that said stacks provide primary shear load support structures for lateral loads exerted on the building structure; and the components for spanning the first and second distances are configured to provide support for internal features of the building structure.

In one embodiment there is provided a prefabricated building module for a building structure, wherein said building module comprises at least one wall section extending vertically between the upper and lower peripheral edges of the building module, wherein the building module is configured to be securable in a stack of like prefabricated, building modules so that one or more resulting columns of said wall sections act as a loadbearing structure for the building structure and wherein said well sections are at least one of: between 80-160 mm inclusive thick, between one sixth and one quarter of the density of concrete and relatively more ductile than concrete.

Other embodiments comprise a combination of two more embodiments described above. Still further embodiments will be apparent from the following description.

BRIEF DESCRIPTION OF THE DRAWINGS

FIG. 23B is horizontal cross section of reinforcing parallel flange channel (PFC) section;

DETAILED DESCRIPTION

The following description is given by way of example of a residential building. However, it will be appreciated that same or similar components and methods that form embodiments of the invention may be applied to other buildings, including for example retirement living, aged care facilities, health care facilities, and commercial buildings.

Figure 1:
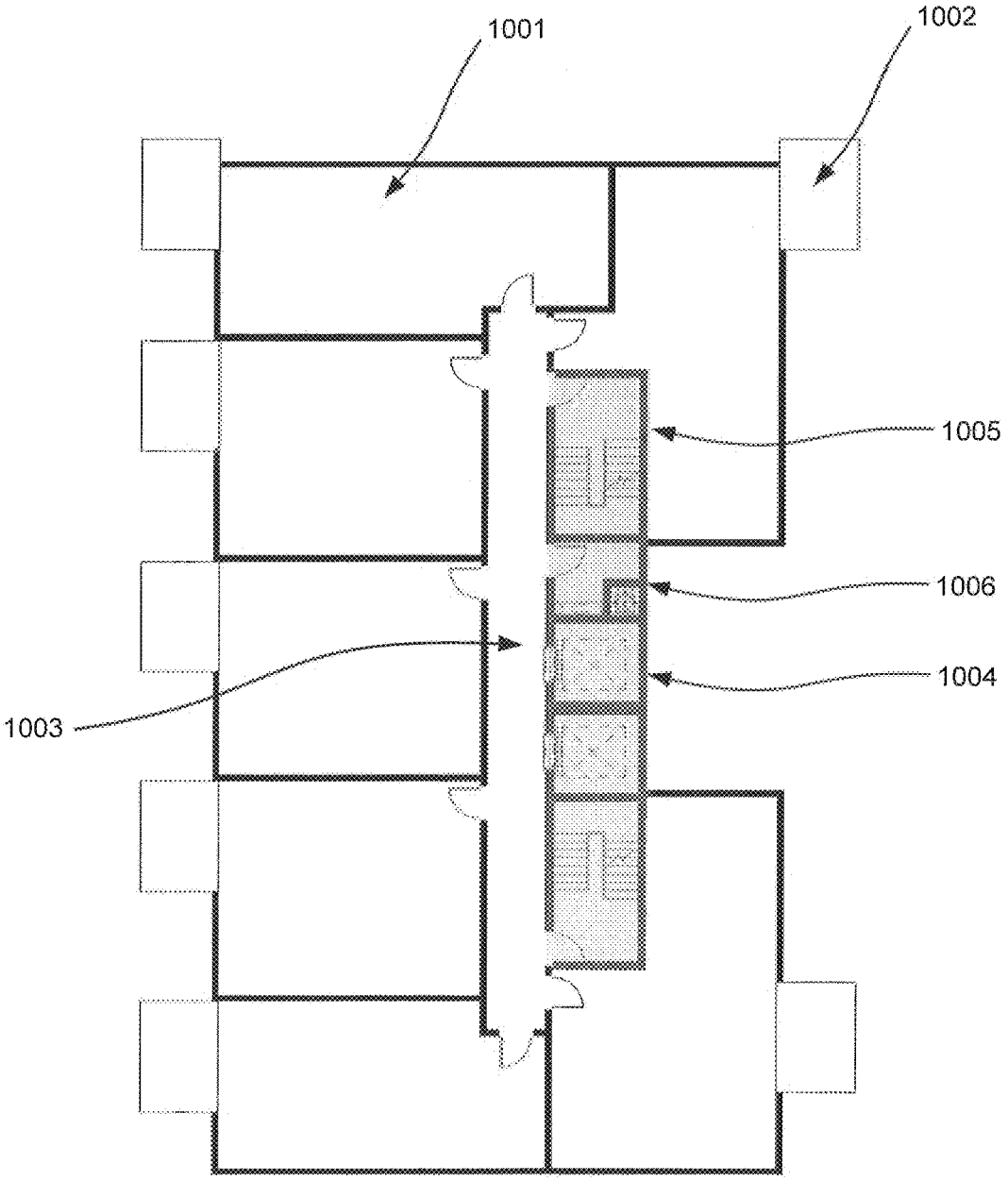
FIG. 1 is a floorplan of an apartment building constructed utilising prior art building processes and structures.

FIG. 1 is a floorplan of a building structure, which is one of a plurality of floors of a residential building constructed according to techniques in the prior art. The floor 1000 includes several apartments 1001, in this example seven apartments generally distributed around a central corridor or hallway 1003. Some, or in this example all, of the apartments 1001 include a balcony 1002.

The components forming the apartments 1001, balconies 1002 and hallway 1003, including walls, floors and ceilings are constructed around a central core. The central core in this example building includes a pair of lift shafts 1004, a pair of stairwells 1005. The lift shafts 1004 will each accommodate a lift and the stairwells 1005 a staircase.

The central core in the example building also includes a service riser 1006. Throughout this specification, the term "service riser" is used to describe a vertically extending column or space for enclosing service conduits, whether or not that column or space includes the service conduits. The service riser 1006 accommodates the services to the apartments, including for example electrical and communication cables, water, wastewater and sewerage pipes, gas lines. The services are then distributed to at least the apartments 1001 and hallway 1003 as required.

Typically, the central core provides much of the gravitational and shear force support for the building and is constructed first, with the apartments 1001, balconies 1002 and hallway 1003 secured to the core. The central core may, for example, be constructed from concrete with the load bearing walls having a substantial wall thickness and/or other appropriate reinforcing to provide the required support. For example, some buildings may have about 300 mm thick concrete walls. The number and thickness of the walls in the core will depend on the specific building characteristics and requirements, including for example the number of floors, the environment in which the building is constructed, regulatory requirements and whether the building has a single core or two or more cores.

According to some prior art techniques for utilising prefabrication, floor, wall and/or ceiling components may be prefabricated and transported to the site for assembly.

Figure 2:
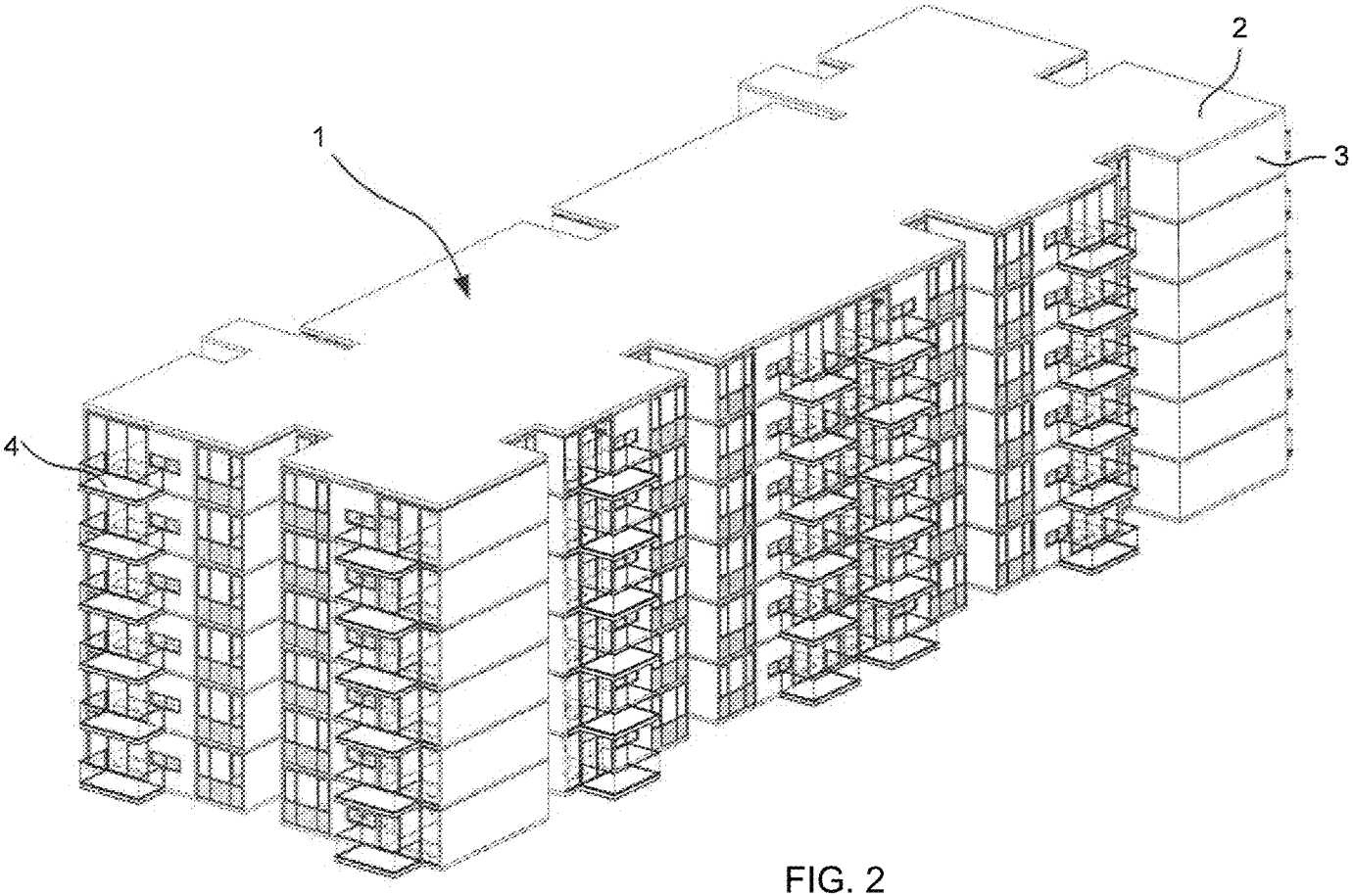
FIG. 2 is a top perspective view of an apartment building constructed utilising building processes and structures in accordance with the present disclosure.

An example building 1 constructed utilising building processes and structures in accordance with the present disclosure is depicted from a top perspective view within FIG. 2. The building 1 in this example includes six floors 3 and may be an apartment building, including balconies 4. The apartment building 1 includes a roof 2 and foundation (not shown), constructed using known prior art techniques. From outward appearances, the apartment building 1 may look similar to buildings constructed using the aforementioned prior art techniques. However, as is explained in more detail below, the appearance in some embodiments may also be different, for example as a consequence of the use or increased use of variations, including for example variations in the lift wells and stairwells, which may take the form of glass elevators, wooden staircases and suspended or floating staircases or other variations from the prior art concrete stairwells within the core of a building.

Figure 3:
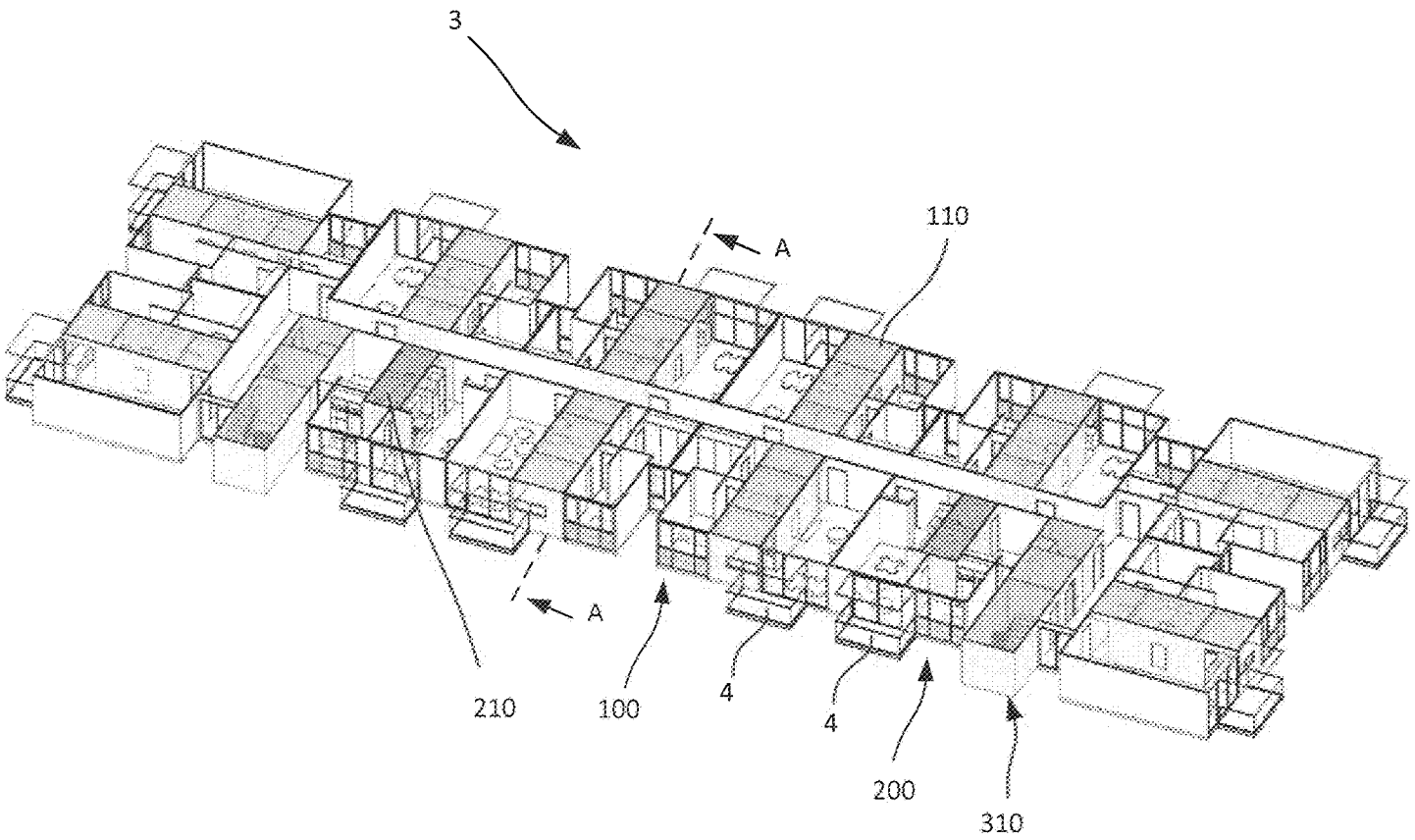
FIG. 3 is a top perspective view showing a cutaway of one embodiment of a floor of the apartment building depicted in FIG. 2.
Figure 4:
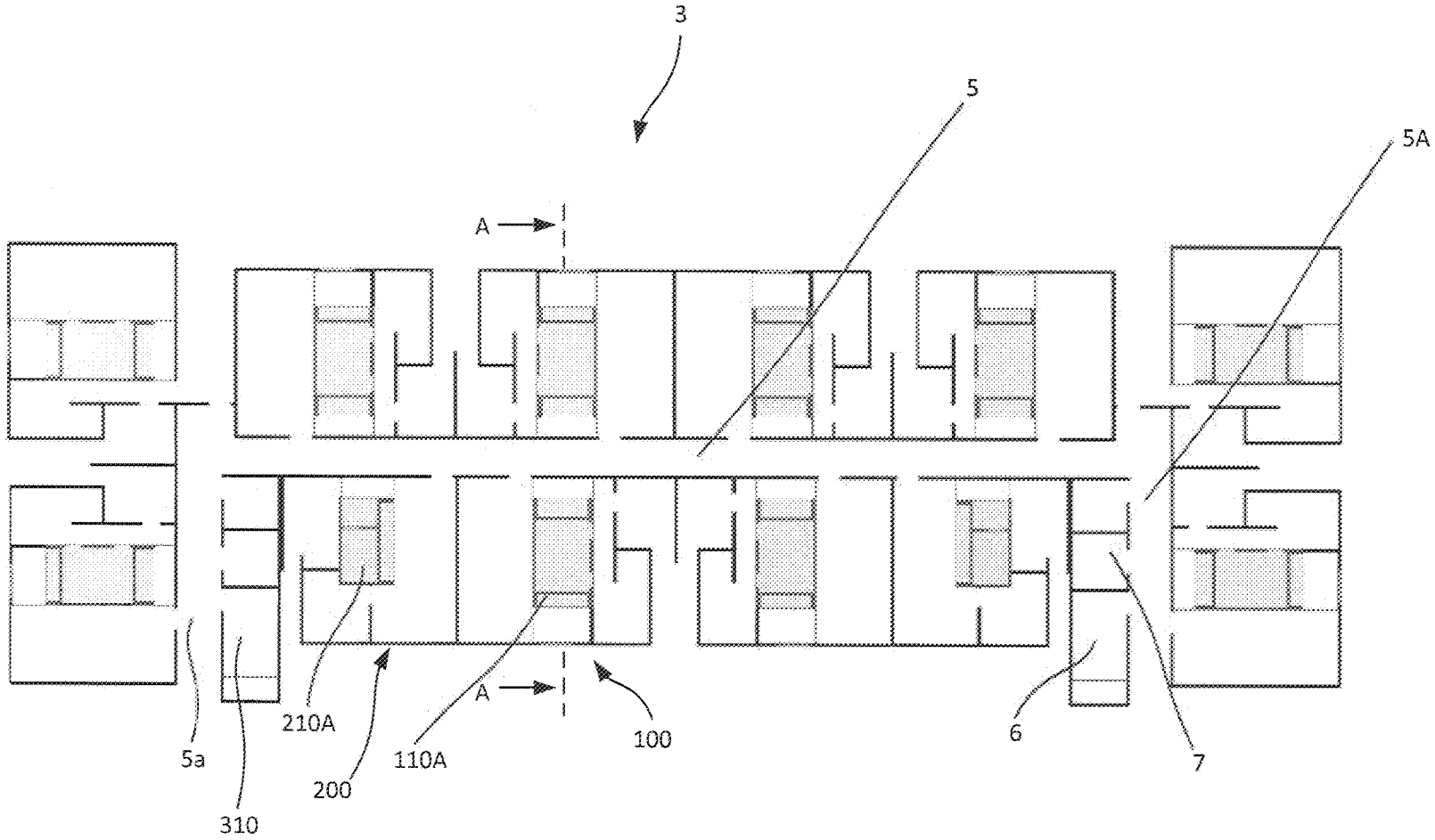
FIG. 4 is a floorplan of another embodiment of a floor.

One embodiment of a floor 3 is shown in FIG. 3, which is a top perspective view showing a cutaway of the floor 3. Another embodiment of a floor 3 is shown in FIG. 4, which is a floorplan view of the floor 3. The embodiment shown in FIG. 4 is a similar embodiment to the embodiment shown in FIG. 3, with some variations. Like reference numerals are used for like parts in the embodiments shown in FIGS. 3 and 4.

In the embodiments of both FIGS. 3 and 4, a single hallway 5 extends longitudinally along the length of each floor 3 of the apartment building 1. At each end the hallway 5 extends to lateral sections 5*a*, which in this example extend to an external wall of the apartment building 1. A stairwell 6 and two lift shafts 7 are provided at each longitudinal end of the apartment building 1, positioned at the lateral sections 5*a* of the hallway 5. The floor 3 includes twelve apartments of two different types, namely ten type one apartments 100 and two type two apartments 200.

In the embodiments of both FIGS. 3 and 4, each apartment type is constructed utilising a corresponding type of building module. Type one apartments 100 are provided with type one building modules 110 and 110A in FIGS. 3 and 4 respectively. Type two apartments 200 are provided with type two building modules 210 and 210A in FIGS. 3 and 4 respectively. A principal difference between the two illustrated embodiments of type one building modules 110 and 110A is that the building module 110 is longer and thus extends further across the apartment (in this case across the entirety of the type one apartment 100), than the building module 110A, which extends partially across the type one apartment 100. Similarly, a principal difference between the two illustrated embodiments of type two building modules 210 and 210A is that the building module 210 is longer and thus extends further across the type two apartment 200, than the building module 210A. In still other embodiments, the building module may extend to the periphery of one side of an apartment (e.g. which may be bounded by a common area such as a hall or bounded by the external walls or perimeter of the building) and not the other.

Another principal difference between the two embodiments shown in FIGS. 3 and 4 is that in FIG. 3 the stairwells 6 and lift wells 7 are provided by a third building module type (type three building module 310). While the stairwells 6 and lift wells 7 have the same configuration, in the embodiment shown in FIG. 4 the stairwells 6 and lift wells 7 are constructed on-site, whereas in the embodiment shown in FIG. 3, these are prefabricated and provided as prefabricated modules, namely the type three building modules 310.

As will be appreciated from the foregoing description of FIGS. 3 and 4, the floor 3 includes a number of prefabricated modules distributed throughout the floor 3. These prefabricated modules, the type one building modules 110, type two building modules 210 and type 3 building modules 310 are shaded in both figures. In each floor 3 of the building 1, the building modules 110, 210 and 310 are vertically aligned. As is explained in more detail below, the building modules 110, 210, 310 provide gravitational and shear force stability to the building. Accordingly, in the embodiment of FIG. 3 there are fourteen columns providing gravitational and shear force stability. The fourteen columns are distributed across the building, in the embodiment shown with approximately uniform distribution. This may be contrasted with some prior art buildings with such stability provided by a central core, in which there may be substantially less stability providing columns, for example one or two (see for example FIG. 1, which shows a building with a single core). The building modules are prefabricated volumetric building modules. By volumetric, it is meant that the modules contain a working space of the building, such as one or more rooms, a stairwell and/or a lift well. This is in contrast to prefabricated components that may form a structural part of the building, but do not accommodate a working space of the building.

In one embodiment, the functionality of the service riser(s) in the core(s) of prior art buildings (e.g. the service riser 1006 of FIG. 1) is provided by one or more of the building modules 110, 210, 310, For example, each of the building modules 110, 110A may carry services for their respective apartment and the apartments vertically aligned with it. In other embodiments only some of the modules 110, 110A are used to carry services, with the others having the corresponding space left void or the module configuration varied to provide an alternate use. Similarly, each or some of the building modules 210, 210A and/or each or some of the building modules 310 may carry services, each generally allocated to carrying services to the areas local to the vertical stack of building modules in which they are located.

The prefabricated modules across floors that carry services are positioned so that the service risers vertically align. More generally, in one embodiment the vertically aligned prefabricated modules across floors have the same configuration of service risers, so that when they are vertically stacked at least the service risers align. In one embodiment the service risers provide substantial gravitational and shear force stability and the load bearing walls of the service risers are aligned to provide load bearing columns. Other parts of the prefabricated modules, for example other walls of the prefabricated modules may also or instead be load bearing to provide the gravitational and shear force stability. Some columns of prefabricated modules may function to provide primarily gravitational force stability and others shear force stability, with some variation in structure dependent on the allocated function. Alternatively, all columns of prefabricated modules may provide equal or approximately equal stability.

In some embodiments of an apartment building, every apartment includes a prefabricated module (e.g. a type one module 110 or 110A or a type two module 210 or 210A) that includes a service riser. In these embodiments the service risers of each module may supply services solely or predominately to the apartment in which they are located. Some or all of the prefabricated modules may also provide through their respective service risers services to common areas, for example to the hallway 5 and/or the stairwells 6.

In some embodiments of an apartment building, every apartment includes a prefabricated module (e.g. a type one module 110 or 110A or a type two module 210 or 210A) that provides gravitational and shear force stability to the building and includes a hydraulic riser. In these embodiments the hydraulic risers of each module may drain wastewater solely or predominately from the apartment in which they are located. Services may be supplied to respective apartments from a conventional service riser of the building via a common corridor outside the apartment. The services may enter the apartment through the building module, and the services distribution infrastructure may be concentrated in the building module.

Figure 5:
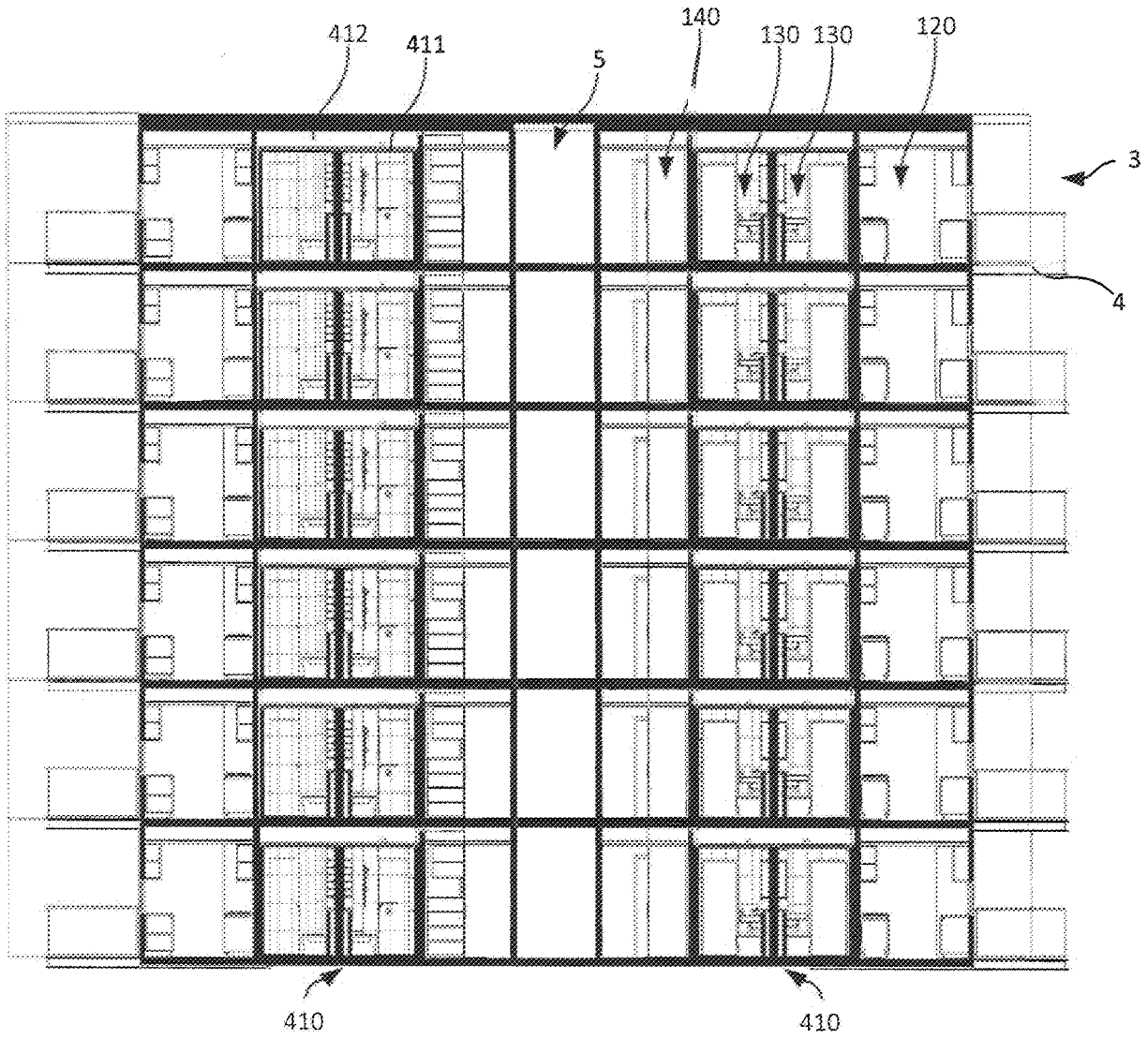
FIG. 5 is a cross section of an apartment building.

FIG. 5 shows another embodiment of an apartment building. The embodiment shown in FIG. 5 is a similar embodiment to the embodiment shown in FIG. 3, with some variations. Like reference numerals are used for like parts in the embodiments shown in FIGS. 3 and 5. FIG. 5 is a cross section through the building, for example at a location similar to line AA in FIG. 3.

Like the building in FIG. 3, the building in FIG. 5 has a central hallway 5 and balconies 4. In the embodiment shown in FIG. 5, a fourth building module is shown (type four building module 410). The type four building module 410 is similar to the type one building module 110 and extends from the hallway 5 to the perimeter of the building.

Six type four building modules 410 are arranged vertically adjacent each other to form a module column, with two columns depicted in FIG. 5, Like the embodiment in FIG. 3 (as opposed to the embodiment of FIG. 4), the type four building modules 410 extend from the hallway 5 to the perimeter of the building. The building modules 410 are each prefabricated to include a kitchen 120, two bathrooms 130 and a laundry 140. It will be appreciated that different configurations of kitchen, bathroom and laundry may be provided, including omitting some rooms where reduced functionality is provided. For example, if centralised laundry facilities were provided for each floor, then the laundry may be omitted from building modules 410. The laundry in this case may be either present in another column of prefabricated modules, or built on-site. Where the laundry is build on-site, it may be supplied by services running through the building modules 410.

The type four building modules 410 are representative of an embodiment in which the service-heavy parts of the (in this case apartment) building are provided through prefabricated modules. Provision of services can be a labour intensive aspect of building construction, so pre-fabricating the services may lead to gains in efficiency. In addition, the components required for services would otherwise need to be transported to the building site if not included in a prefabricated component.

The type four building modules 410 are also representative of an embodiment in which the content of the rooms is prefabricated. Rooms such as bathrooms, laundries and kitchens often have more fixtures in them (e.g. taps, drains, sinks, counters, cupboards, toilets) in comparison to other room like bedrooms, dining rooms and lounges. The fixtures take up space and represent components that would otherwise need to be transported to the building site if not included in a prefabricated component. Accordingly, increased efficiency gains may be obtained by prefabricating the parts of the building with a higher proportion of fixtures.

FIG. 5 shows an embodiment of how services may be distributed from a service riser throughout the building module. In this embodiment the ceiling 411 of the building module 410 is lowered, leaving a services cavity 412, in which may be located the components required to distribute the services, for example electrical cables, plumbing, gas lines, and water sprinkler lines. In this embodiment, the lowered ceiling 411 is suspended below the roof to form the services cavity 412. In another embodiment, the ceiling 411 and the roof may be formed integrally at a position below the upper edges of the walls of the building module 410. In one embodiment, as shown in FIG. 5, the ceiling 411 is lowered throughout the building module 410. In another embodiment, the ceiling, may be lowered near the service riser only and/or along paths from the service riser to required termination points for the services. Where services are required in or across locations where the ceiling has not been lowered, they may be provided through the walls. In still other embodiments the services are provided through the walls and/or floor instead of or in addition to through the ceiling.

Whereas in the embodiments of FIGS. 3, 4 and 5 the modules 110, 10A, 210, 210A and 410 are for a single apartment, in an alternative embodiment each building module may be for more than one apartment. For example, modules may include a dividing wall between two apartments, or be placed in the corners of three or four apartments. In order to take advantages of efficiencies that may be possible by placing the service-heavy and/or fixture heavy parts of the plurality of adjacent apartments (or other building type if not apartments) within the modules.

As described above, the disclosed building modules including for example the building modules 110, 110A, 210, 210A, 310 and 410 provide gravitational and shear force stability to the building. An embodiment in which this may be achieved is described with reference to FIG. 6A, which diagrammatically depicts another embodiment of a building module 10. The building module 10 is similar to the building module 110A shown in FIG. 4. The characteristics of the building module 10 to provide gravitational and shear force stability may also be applied to other embodiments of the building module disclosed herein.

The building module 10 is formed as a generally rectangular prism. The overall dimensions may be selected depending on the requirements for the building to be constructed using building modules 10, including for example ceiling height, size of the rooms within the module (e.g. bathroom, laundry, kitchen) and aesthetic requirements. The overall dimensions may also be selected having regard to the requirement to transport the prefabricated module to the building site. For example, in order to be transported by truck the width of the building module may be about 2.5 or 3 metres and the length up to about 12 or 13 metres. The specific maximum dimensions will likely be dictated by road regulations for the location where the building module needs to be transported. Alternative dimensions may be available if it is permissible to carry over sized loads (e.g. with a pilot vehicle) or if alternative means of transport (e.g. rail) is available.

The building module 10 includes two primary load bearing walls 13. Referring to the orientation shown in FIG. 6A, these are a vertical front side wall 13A and a vertical rear side wall 13B, which are spaced apart in a lateral direction of the building, module 10, and extend parallel in a longitudinal direction of the building module 10. Two rectangular cut-outs are formed in the front side wall 13A, which provide for doorways to allow access to the interior of the building module 10.

A space between the upper edges of the front and rear side walls 13A, 13B is bridged by a horizontal roof 11. A horizontal floor 12 is spaced apart from the roof 11 in the vertical direction, and bridges a space between lower edges of the front and rear side walls 13A, 13B, parallel to the roof 1. This generally rectangular prism is capped at one end by a vertical left end wall 14A and at another end by a parallel right end wall 14B.

In one embodiment, the side walls, roof, floor and end walls of the building module are cross-laminated timber (CLT). For example, each may be formed from a single panel of CLT formed into an appropriate shape. The panels may be of equal or varying thicknesses. In one embodiment the panels that provide gravitational and shear load stability may be thicker than or reinforced in comparison to at least some of the other panels. By way of example, the side walls 13A, 13B may utilise five layer CLT with a total thickness of 120 mm, the roof 11 may utilise three layer CLI with a total thickness of 60 mm, the floor 12 and end walls 14A, 14B may utilise three layer CLT with a total thickness of 80 mm.

It will be appreciated from the example above, that the wall thickness of the load bearing walls, within the range of about 80-120 mm is substantially less than the thickness describe above with reference to the prior art of about 300 mm (concrete). This reduction in thickness may be achieved by one or both of a selection of materials (e.g. CLT as opposed to concrete) and an increased number of load bearing columns (e.g. more than one or two, for example three, four or more, six or more, eight or more, ten or more or a dozen or more). The material or materials selected for the load bearing walls may be a lightweight panel (relative to concrete), for example a panel having an average density or weight of about one sixth, about one fifth, or about, one quarter of the density or weight of concrete respectively. In some embodiments the material selected may be substantially more ductile in comparison to normal strength concrete in a direction transverse to the load exerted by the force of gravity. Depending on the requirements for the building and the selection of materials and number of load bearing columns, the thickness of the load bearing walls may be reduced down to about 60 mm, or increased to about 140 mm, 160 mm, 180 mm, 200 mm, 220 mm or 240 mm.

Figure 6B:
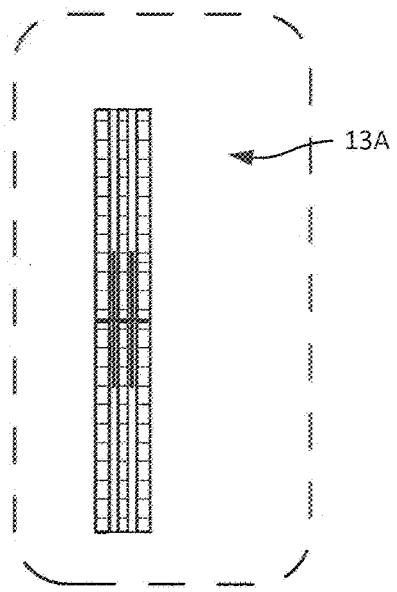
FIG. 6B is a cross section of a joining system used to join side walls of vertically abutting prefabricated building modules.
Figure 6A:
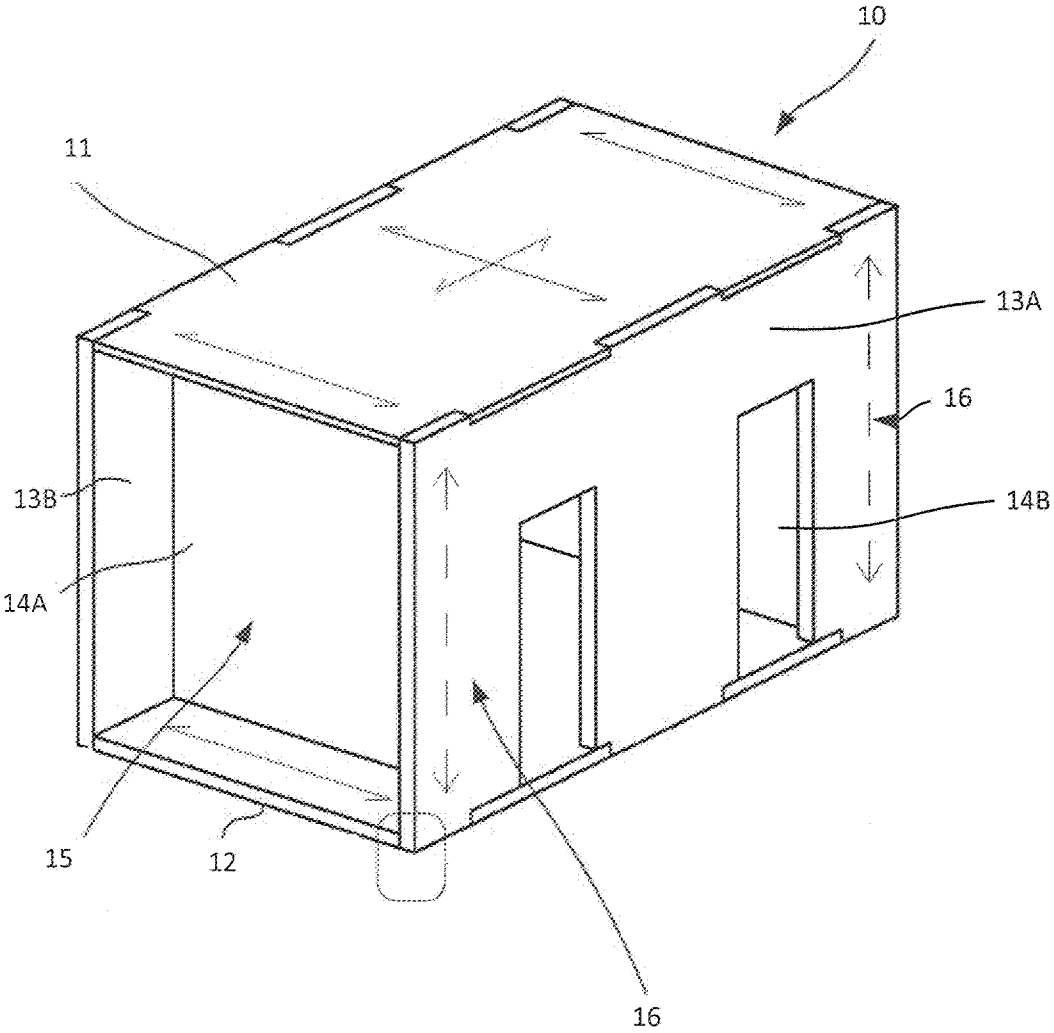
FIG. 6A is a top perspective view of an embodiment of a prefabricated building module in accordance with the present disclosure.

In one embodiment as shown in FIG. 6A, the end edges of the side walls 13A, 138, roof 11 and floor 12 are formed to be flush with each other, through a tongue and groove arrangement. Optionally one or both of the end walls 14A, 148 may also be formed flush. In the embodiment shown the end walls 14A, 148 are inset, thereby forming alcoves 15, 16 at the ends of the building module 10. The alcoves can be used to accommodate additional building elements within the building module. For example, the two alcoves 15, 16 may accommodate fixtures for a kitchen and laundry, and the interior of the building module 10 may be one or two bathrooms. The distribution of kitchen, laundry and bathroom(s) may be varied between the internal space of the building module 10 and the two alcoves 15, 16.

In this embodiment, the front and rear side walls 13A, 13B are both configured to act as major vertical load (gravitational) bearing and lateral (shear) load resisting parts of the building structure in which the building module is incorporated. The building module 10 and its corresponding building structure are configured such that lateral loads exerted on the building structure, such as wind and seismic loads, concentrate tension and compression forces generally along load bearing columns 16. In other words, the front and rear side walls 13A, 13B provide raking resistance by resolving horizontal loads, which are applied to the building structure, as tension and compression in the load bearing columns. In one embodiment the load bearing columns are generally at the extremities of the side walls 13A, 13B of the building module 10. In some embodiments, these regions may include reinforcement, for example by steel reinforcing I-beams or glued laminated timber. Alternatively the materials for the panels that include a load bearing column may be selected having regard to the requirement to bear load (e.g. CLT may be appropriate). At least at the location of the load bearing columns 16, the side walls 13A, 13B extend the entire height of the building module 10. Accordingly, one building module 10 may be stacked directly on top of another building module with the same configuration, or at least a configuration allowing their respective load bearing columns 16 align or substantially align, to form a continuous load bearing column 16 across multiple stacked modules. The location, number and size of the load bearing columns may be varied in different embodiments.

FIG. 6B is an enlarged view of a cross section taken through an example of a joint where the lower edge of a CLT front side wall 13A of a first building module 10 abuts against the upper edge of the front side wall 13A of a second building module 10, wherein the first building module is stacked on the second building module. This joint between the respective side walls of the first and second building module utilises an embedded steel plate and self-perforating dowel system. As mentioned previously, the side walls may utilise five layer CLT panels with a thickness of 120 mm. Alternatively, the side walls may utilise three, seven or more layer CLT panels. These three, five or seven layers of the CLT panel comprise primary lamella and secondary lamella alternately laminated in a symmetric cross section and bonded together under pressure with adhesive. During prefabrication, steel plates are embedded into the secondary lamina.

Figure 7:
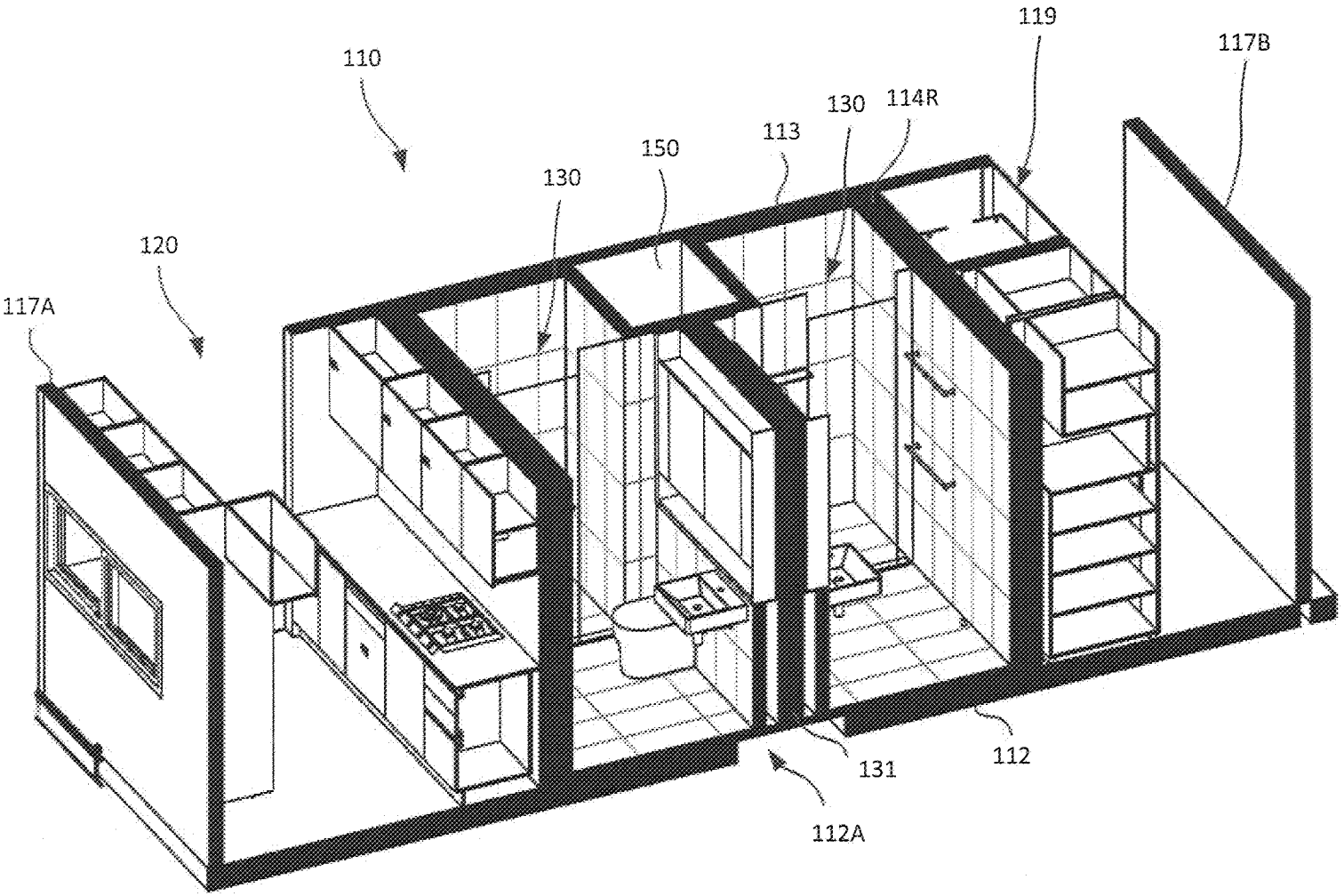
FIG. 7 is a top perspective vie r showing a cutaway of an embodiment of a prefabricated building module.
Figure 8:
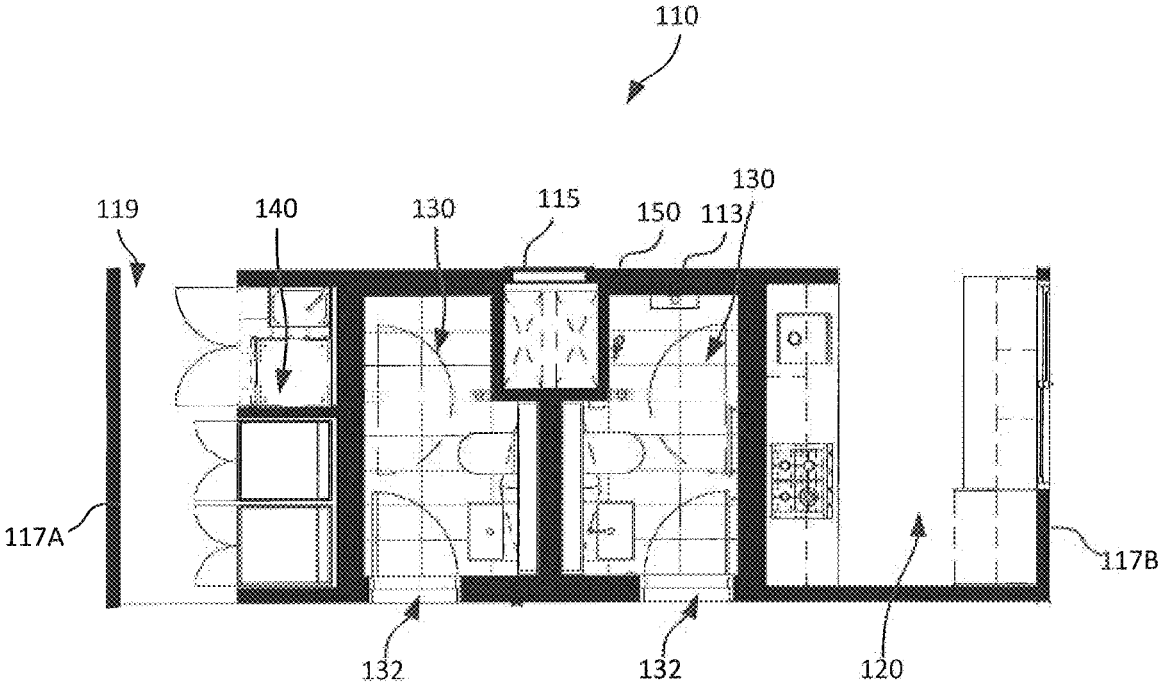
FIG. 8 is a floorplan of the prefabricated building module depicted in FIG. 7.

FIGS. 7 and 8 depict the specific arrangement of an embodiment of a building module, which may be the same as or similar to the building module 110 shown in FIG. 3 and/or the building module 410 shown in FIG. 5. Accordingly, like reference numerals will be used for like components. FIG. 7 is a top perspective view, having the roof, the ceiling and the front side wall cutaway. FIG. 8 is a floorplan. The building module 110 comprises a front vertical side wall (not shown) and a rear vertical side wall 113, left and right vertical end walls 117A, 117B, a horizontal roof (not shown) and a horizontal floor 112, all of which form a generally rectangular prism. These components may utilise the same materials and structural configuration as described in relation to the building module 10, and thus a detailed description of these features will be omitted from the following.

The interior of this rectangular prism is divided into two bathrooms 130 by an internal wall 131. This is intersected by a service riser 150. The roof and floor at the location of the service riser include apertures to allow services to run vertically through a column of building modules 110. In addition, in this embodiment the floor includes a services channel 112A, which carries services to the bathrooms 130, or alternatively to the bathrooms of another building module 110 stacked below the depicted building module 110. The floor 112 may include additional services channels across the floor 112. The two bathrooms 130 are in this embodiment laid out as mirror images of each other, such that two toilets and two vanity basins are provided back-to-back on the internal wall 130, and a shower cabin is provided next to the service riser 150. Access doors 132 are formed in the front side wall.

Although the building module 110 extends further than the building module 10, similar to the building module 10 the building module 110 includes a laundry alcove and a kitchen alcove on opposite sides of the bathrooms 130. In the example shown, the laundry alcove accommodates a laundry 140, having a washing machine cavity and a laundry tub and two storage cabinets. Other examples of laundry alcoves may have alternative configurations, for example configurations in which one or more of the washing machine cavity, laundry tub and storage cabinets are omitted from the laundry, and/or additions are made to the space occupied by and/or components in the alcove. In the example shown, a passageway 119 is formed between the laundry alcove and a left external wall 117A (which may form an exterior wall of the building), and the kitchen alcove accommodates a kitchen benchtop that is provided with a stove and a sink. A kitchen space 120 is between the kitchen alcove and a right external wall 117B (which may be internal to the building). The rear side wall 113 of the building module is formed with an access hatch 115 to allow service personnel to access the service riser.

The walls of the building module 110 that form, are expected to form, or include load bearing columns (e.g. as described with reference to FIG. 6A) are depicted thicker and may be thicker (or reinforced or of a different material) than the other walls. Utilising thinner (or non-reinforced or lighter material) walls for the other walls may result in efficiency gains. In addition, some of the walls, including the thicker walls may carry services, instead of through the services cavity 412 formed between the roof and the ceiling or in the floor.

Figure 9:
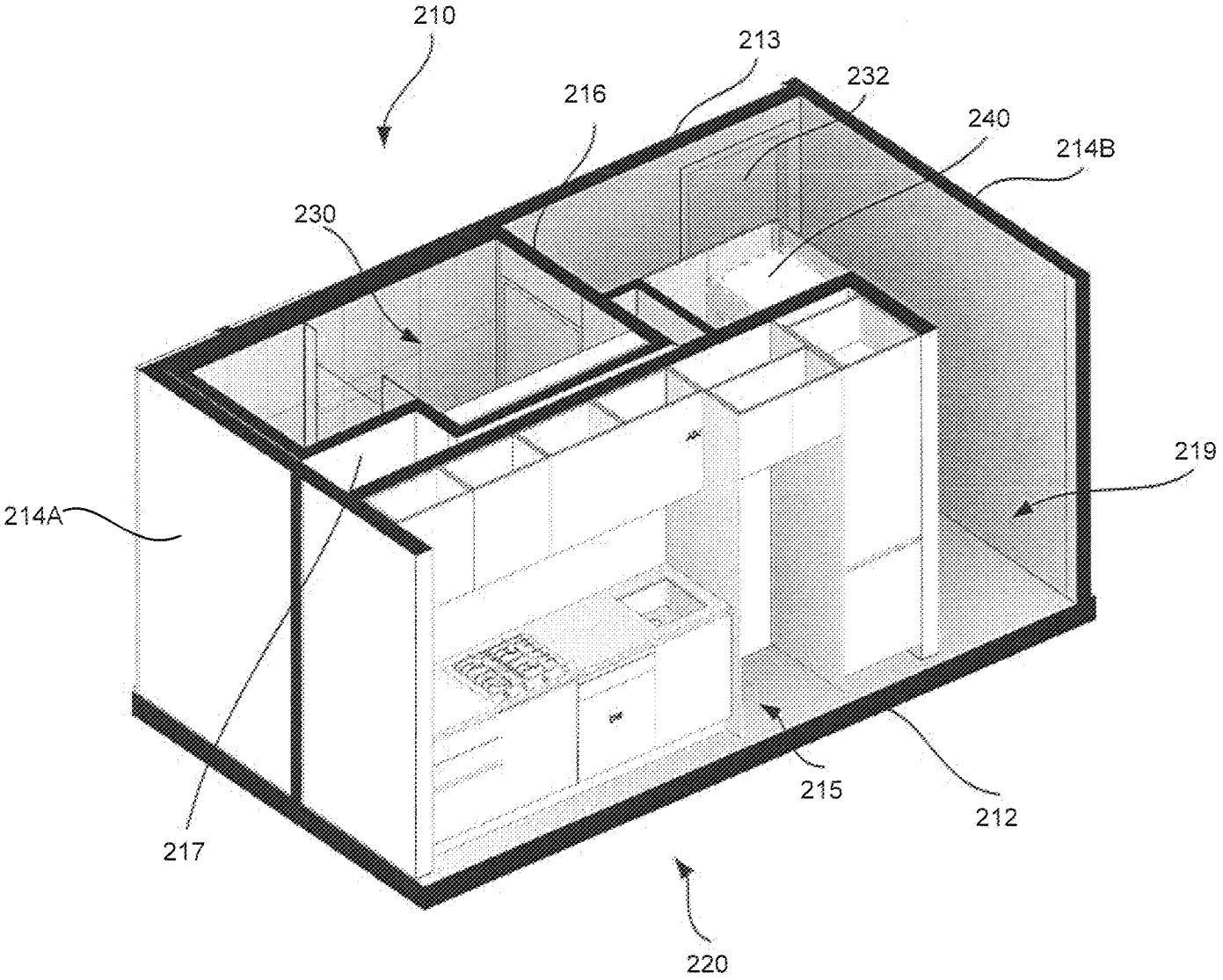
FIG. 9 is a top perspective view showing a cutaway of an embodiment of a prefabricated building module.
Figure 10:
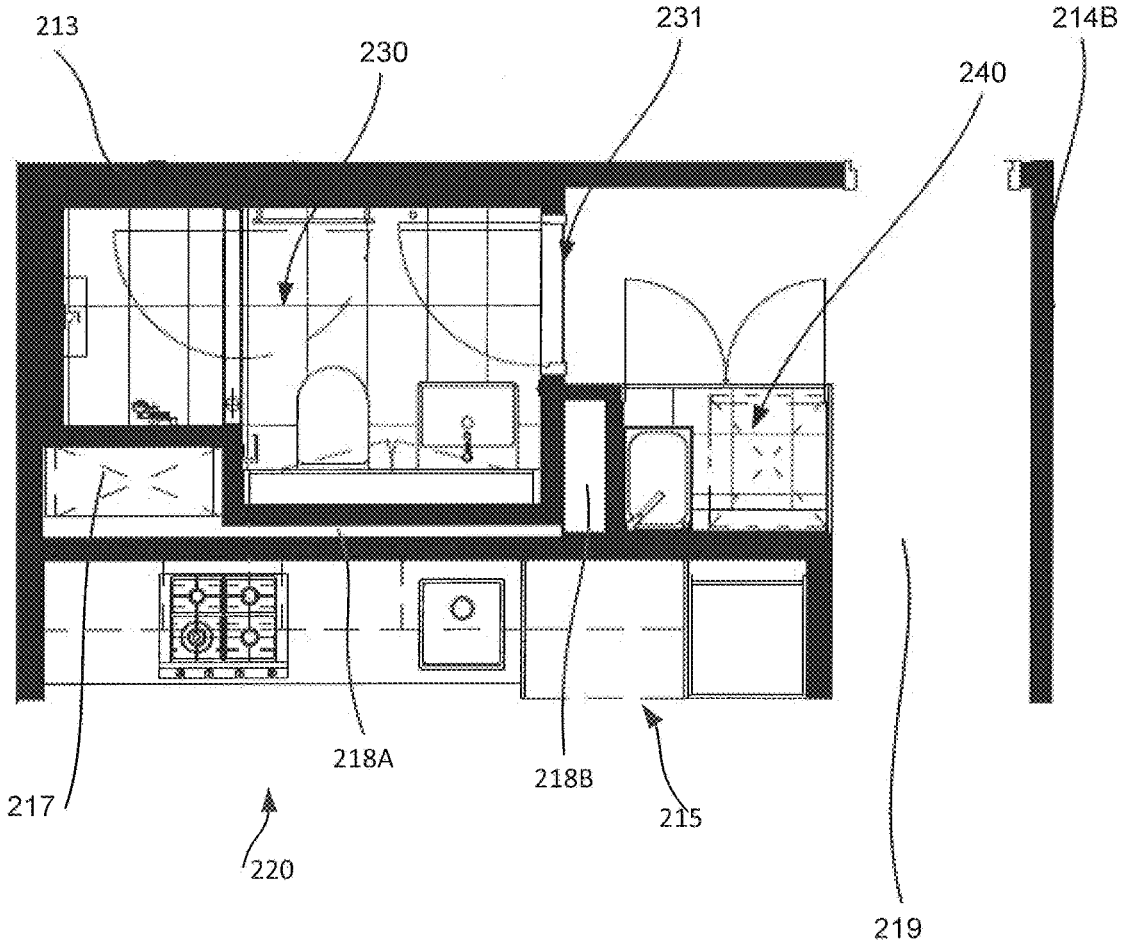
FIG. 10 is a floorplan of the prefabricated building module depicted in FIG. 9.

FIGS. 9 and 10 depict a further embodiment of a building module 220; FIG. 9 showing a top perspective view and FIG. 10 showing a floorplan. The building module 220 does not include a roof. Instead, the roof of one building module 220 is formed by the floor of another building module. Other embodiments described herein may omit ceiling panels, with the services running through one or more of the walls, floor and a service riser.

The building module 220 comprises a rear vertical side wall 213, left and right vertical end walls 214A, 214B, and a horizontal floor 212 to form a generally rectangular prism. The building module 220 includes a kitchen area alcove 215, a service riser 217, a passageway and foyer area 219, a bathroom 230 and a laundry area 240. An internal perimeter wall 216 provides the walls of the bathroom 230 and are located within the outer walls, namely within the rear vertical side wall 213 and left vertical end wall 214A, of the building module 220. The resulting double wall arrangement in this location provides gravitational and shear load stability for a column of vertically stacked building modules 220. An internal wall includes a doorway between areas within the module. In this embodiment, one side of the internal perimeter wall 216 is provided with an internal door 231 to allow access between the bathroom and foyer areas. The passageway and foyer area 219 includes a door 232, which may serve as a door to the apartment and open to a common area of the building in which the building module 220 is located.

Figure 11:
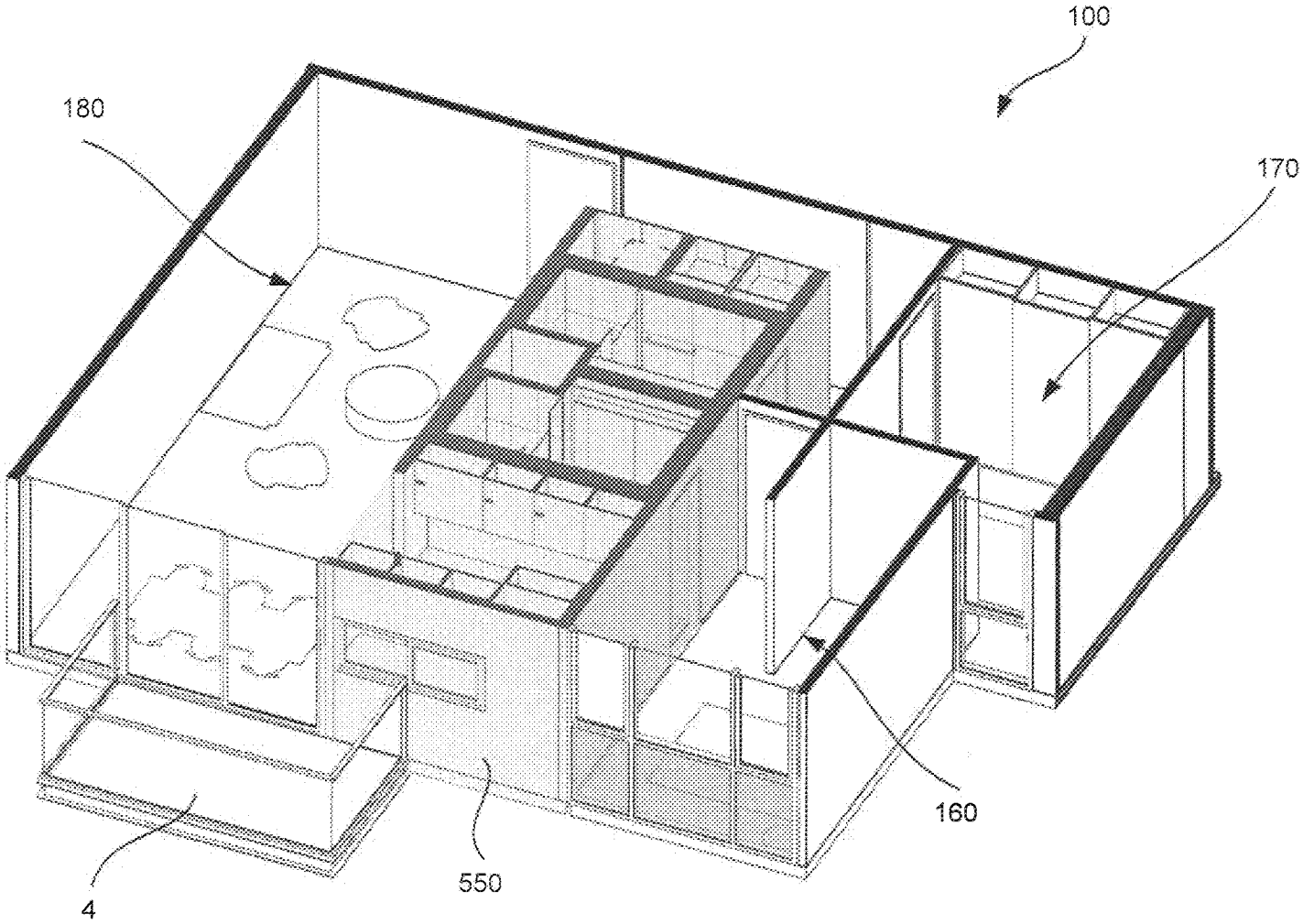
FIG. 11 is a top perspective view showing a cutaway of an apartment.
Figure 12:
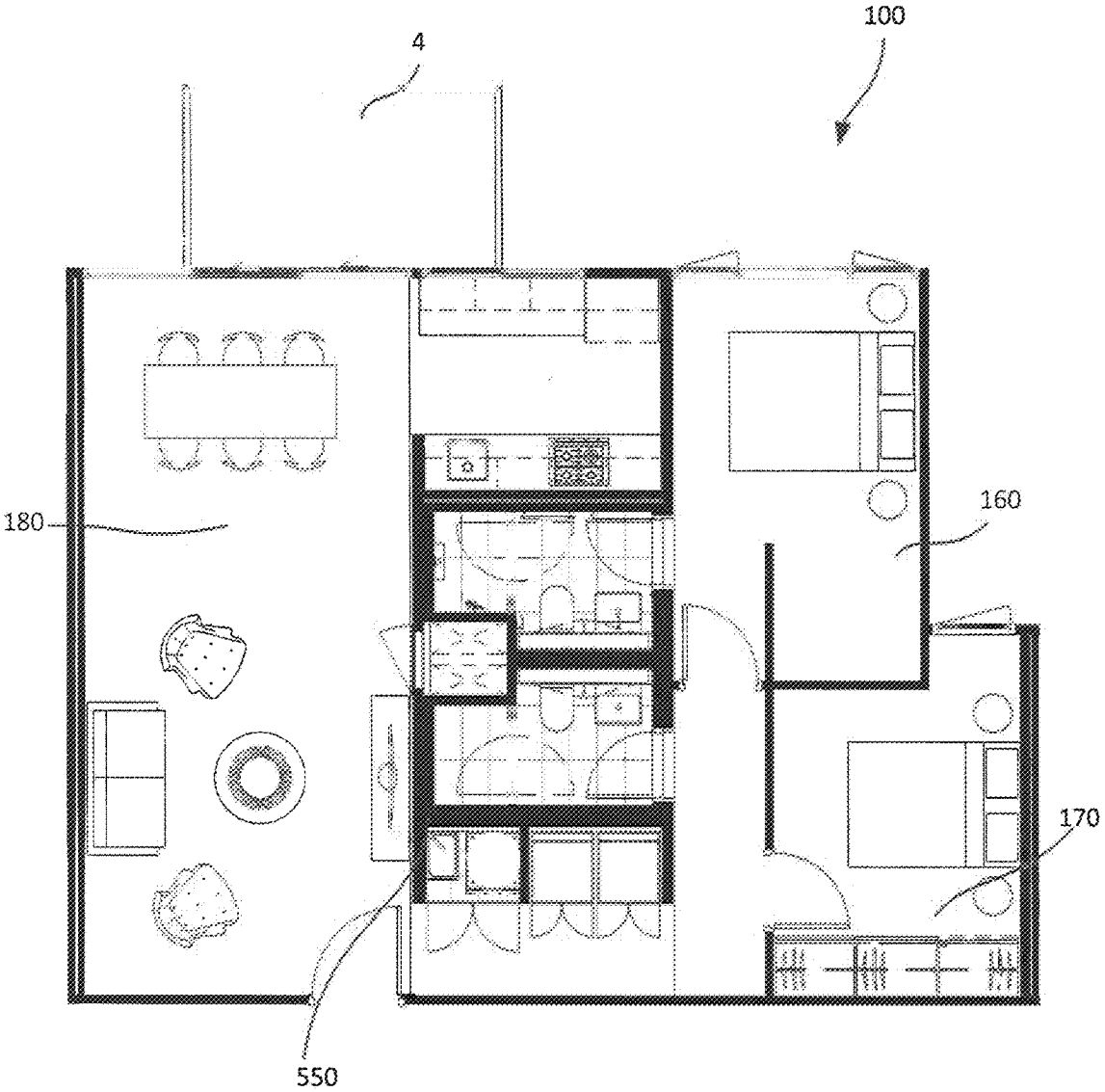
FIG. 12 is a floorplan of the apartment depicted in FIG. 11.

FIGS. 11 and 12 depict part of a floor (an apartment) of a building according to one embodiment. The building includes another embodiment of a prefabricated building module 550. The building module 550 is similar to the building module 110 shown in FIGS. 7 and 8, except that it terminates earlier at one end. As described herein, a plurality of building modules 550 are stacked to provide gravitational or shear stability, with services provided through a service riser.

The apartment includes three other living areas 160, 170, 160. The walls, floors, ceilings and any internal fixtures in the living areas 160, 170, 180 may be constructed or assembled on site. The components comprising the other living areas 160, 170, 180 may be viewed as secondary components, whereas the prefabricated building modules may be viewed as primary components. As described herein, the primary components provide stability to the building, for example gravitational and shear stability. In certain embodiments the primary components provide services to the building. In certain embodiments the primary components include the service intensive parts of the building. In certain embodiments the primary components include the fixture intensive parts of the building. The secondary components span and fill the space between the primary components and may be less intensive in terms of use of services and/or fixtures.

In general, construction of a building proceeds by first positioning and securing primary components in place and locating and fixing the secondary components off or around the primary components. Further secondary components may then be provided off the secondary components directly fixed to the primary components. It will be appreciated that the secondary components can also contribute to the stability of the building or the part of the building in which they are located, including for example providing gravitational and shear load stability. The extent of the contribution relative to the (primary) contribution of the primary components will depend on the design of the particular building and for example may be influenced by the distance between primary components that the secondary components need to span. In certain embodiments this distance may be between about 3 metres and about 5 metres (inclusive). In an apartment context, this may for example represent a difference in available space around the primary components sufficient for a one bedroom apartment through to a three bedroom apartment. Optionally two or more different apartment types (e.g. one bedroom, two bedroom or three bedroom) may have the same primary components (which may be oriented differently to reflect the orientation of the apartments).

In some embodiments, at least some of the primary components are located and the selected secondary components dimensioned such that only one, or only one or two secondary components are required to span the space between primary components. For example, one or two secondary component floor panel structural members, one or two secondary component wall panel structural members and/or one or two secondary component ceiling panel structural members may span the space between primary components. This allows each of the components to be fixed to at least one primary component, taking advantage of the stability provided by the primary components. In some embodiments all or substantially all of the primary components are interconnected with at least one, up to all of its horizontally adjacent primary components by one secondary component. In other parts of the building, three secondary components may span the gap.

In some embodiments secondary components forming external fixtures of the building are at least in part directly secured to the primary components. For example, the balcony 4 in FIG. 11 is secured at one end to the building module 550. As the building module provides stability for the building, it may also readily provide stability to the external fixture, the balcony 4 in this case.

The secondary components may be fixed to the primary components by any suitable mechanism. By way of example, angle brackets may be used. In other embodiments, blocks may be secured to the side wall of the primary component on which a ceiling, floor or roof of the secondary components are placed and secured. In other embodiments the side walls of the primary components may form a tongue or groove for engaging with a complimentary groove or tongue of a secondary component, in a similar manner to that described with reference to the roof, side walls and floor of FIG. 6A. For example, each tongue of the roof 11 may be narrowed to allow space for a tongue of a secondary component roof or ceiling to extend over the side wall 16. In other embodiments, combinations of these and/or other mechanisms may be used.

Figure 13:
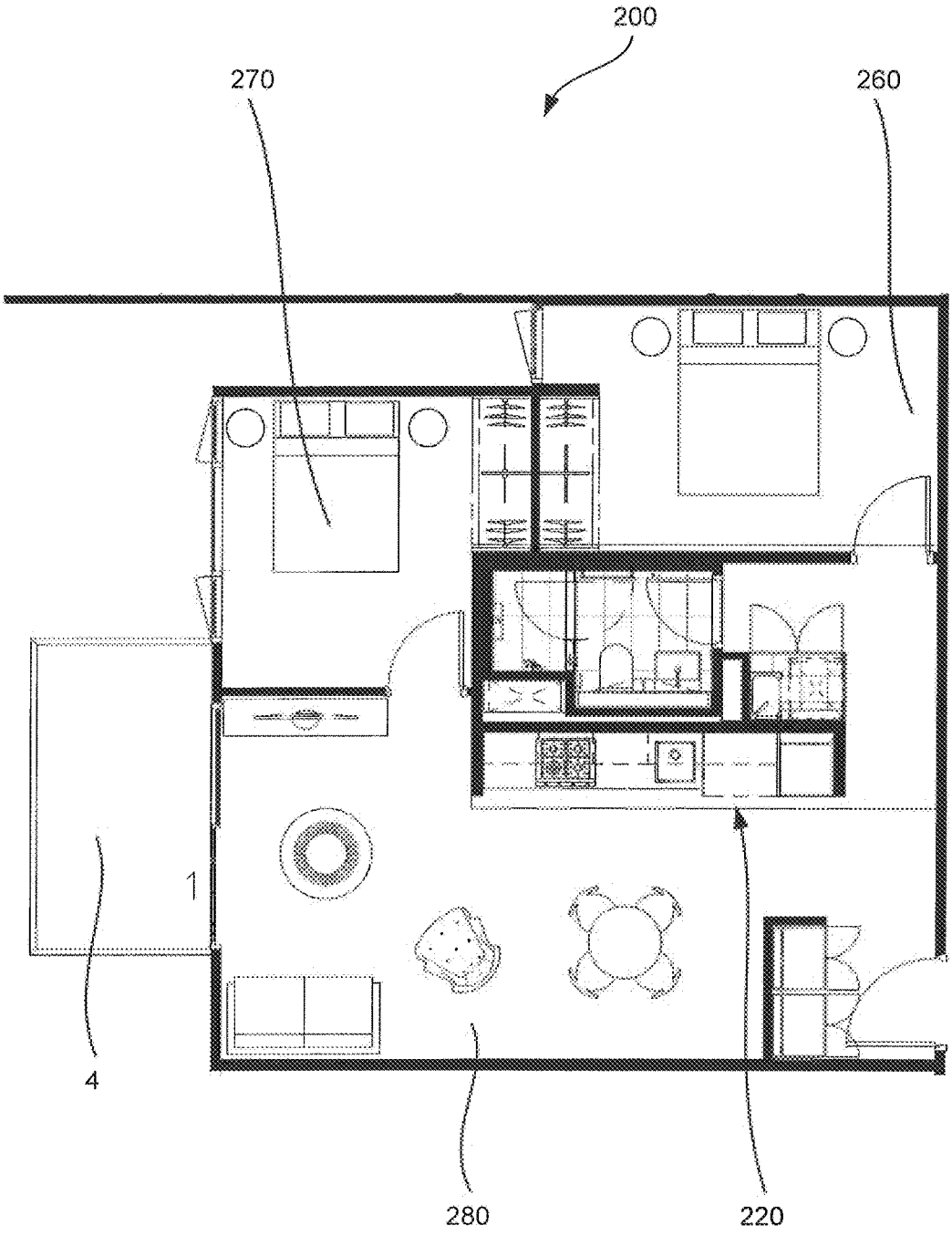
FIG. 13 is a floorplan of another apartment.

FIG. 13 depicts a second apartment constructed around the prefabricated building module 220 described herein above with reference to FIGS. 9 and 10. In this embodiment the building module 220 is central to the apartment, in that secondary components forming rooms or areas 260, 270, 280 surround the building module 220. In this embodiment the secondary component(s) forming the balcony 4 is/are not directly secured to the primary component building module 220.

It will be appreciated from the preceding description and the diagrams, including the floorplans that the primary components collectively occupy a substantial proportion of the horizontal area of the building. In some embodiments, the ratio of the areas occupied by primary components and secondary components may be about 1:8, Other embodiments may use different ratios, greater or lesser than 1:8, for example about 1:3, 1:4, 1:5, 1:6, 1:7, 1:9 or 1:10. In general, ratios greater than about 1:8, 1:9 or 1:10 may require the secondary components to provide substantial additional stability, which may increase the cost of construction. Accordingly, in general the ratios may be less than 1:10, less than 1:9 or less than 1:8.

The secondary components may be constructed from component parts on-site or also prefabricated in volumetric building modules or linear or planar building components. When prefabricated into volumetric building modules their secondary character is indicated by the absence or reduced amount of stability provided to the building by these components and/or by the absence of service risers running through them.

Figure 14:
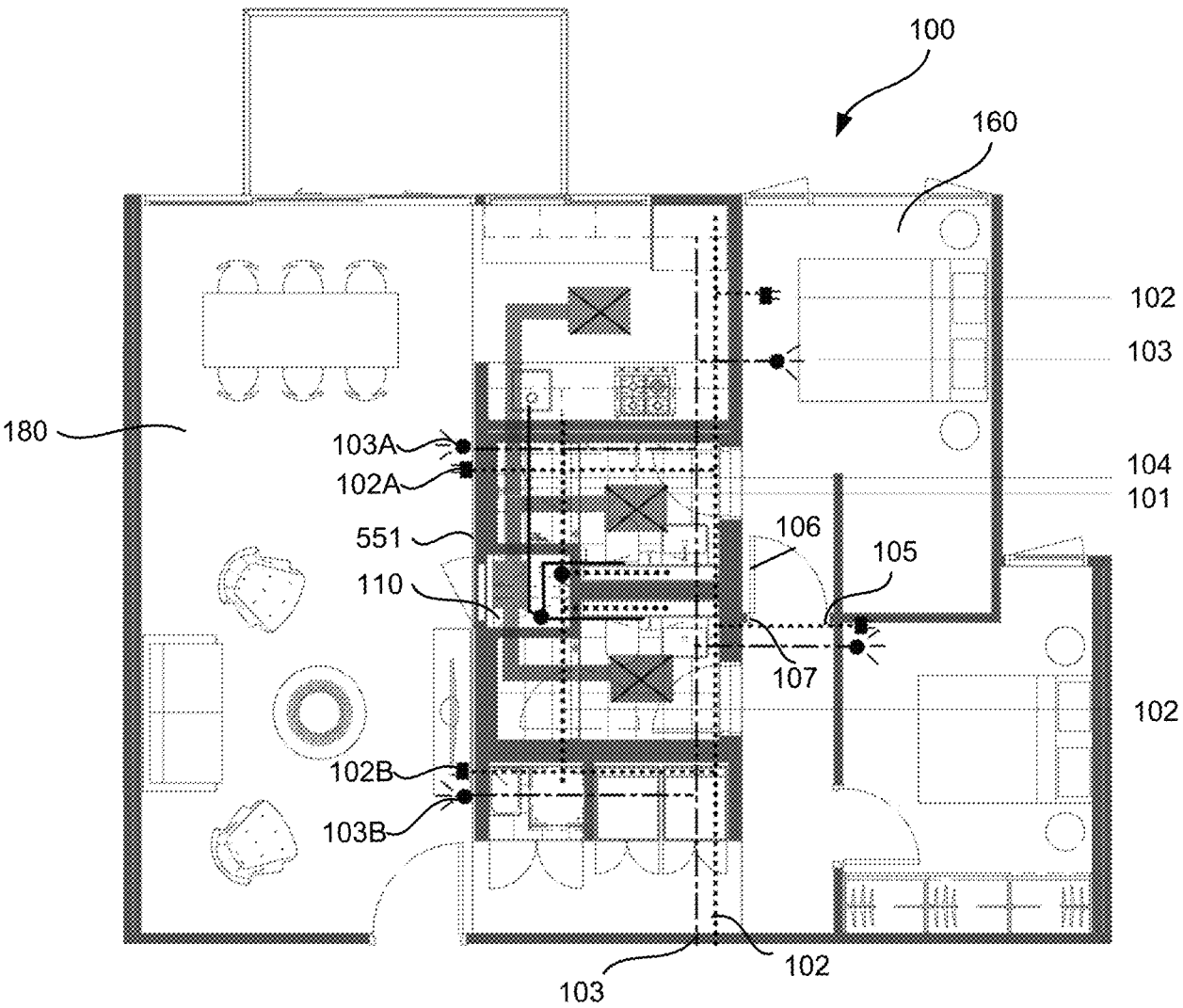
FIG. 14 is a floorplan of an apartment with a services overlay.

FIG. 14 is a services diagram for the apartment 100 of FIG. 12. In this example four services are shown: air extraction conduits 101, electricity cables 102, fire sprinkler pipes 103 and wastewater and sewerage pipes 104. The services may be supplied to the apartment 100 through the service riser 110. Alternatively, some or all of the services may be supplied to the apartment 100 from a central service riser of the building via a common corridor outside the apartment 100. In this embodiment, electricity cables 102 and fire sprinkler pipes 103 enter the apartment 100 from the common corridor at the building module 550. In this embodiment the services travel horizontally through the services cavity 412 formed between the roof and the ceiling or in the floor of the building module 550. The ceiling of the building module 550 may be lower than in other parts of the apartment 100, for example similar to the services cavity 412 described with reference to FIG. 5. Alternatively or in addition, some or all of the services may be distributed via the floor of the building module 550, for example by the provision of services channels, like the service channel 112A described with reference to FIG. 7. Services may be distributed in the vertical direction through the walls and/or other fixtures of the building module.

Some of the services are for rooms within the building module 550. For example, in the embodiment shown air extraction conduits 101 terminate at one of three vents in three different rooms of the building module 550. Water (other than fire sprinkler), wastewater and sewerage pipes (104) may also terminate at fixtures in rooms of the building module 550.

Other services may be for rooms adjacent the building module 550. For example one or more of the services conduits may end at fixtures for adjacent rooms. The sprinklers 103A and 103E are located on a side wall 551 of the building module 550. These are both side spraying water sprinklers. Using side spraying water sprinklers 103A, 103B may allow the ceiling in the room 180 to not carry at least these services, which may avoid the need for a services cavity in the ceiling, in turn allowing the ceiling of room 180 to be higher. Another example of services provided to the room 180 through a fixture of the prefabricated building module is the electrical sockets 102A, 102B, which include fixtures (i.e. termination points) for electricity cables 102. In both cases, the ability to prefabricate the services conduits and fixtures may provide an efficiency gain and the ability to also prefabricate at least some of the termination points for the services may further increase efficiency. As other examples, light sockets, gas terminals and/or air vents may be prefabricated in the lice wall 551 to provide services to the room 180.

Services may also be required for a room separated from the building module 550, for example the room 170. In one embodiment, these services are run through one or more secondary component walls. In one embodiment electricity cables 102 and fire sprinkler pipes 103 are run to the room 170 through a secondary component wall 105, which in the illustrated embodiment carries a door 106. In some embodiments the building module 550 is produced with a connection fixture, which may be a socket 107, adapted to connect with a complimentary connector provided in the wall 105 (which may itself be a prefabricated component). The wall 105 may therefore "plug into" the building module 550. A socket may also be provided for the connection of fire sprinkler pipes 103 and/or other services. The building module 550 may also include mechanical connectors that are adapted to engage with complimentary mechanical connectors on the wall 105. In another embodiment electricity cables 102 and fire sprinkler pipes 103 are run to the room 170 through a ceiling or floor formed by secondary components. In some cases this may require the ceiling to be lowered or floor raised, at least in that location.

Prefabricated services and/or structural connectors may be provided at various locations around the building module 550, particularly when the configuration of the secondary components about the building module is known. In some cases, for example for the room 160, the services connectors or termination points may be located close to, but not on the walls of the building module 550. Various suitable secondary components may carry the services across this distance.

Services may also be provided to or run from locations further remote from the building module 550, for example in FIG. 14 electricity cables 102 and fire sprinkler pipes 103 are run to locations outside of the apartment, which may for example be along a common corridor outside the apartment 100.

Figure 15:
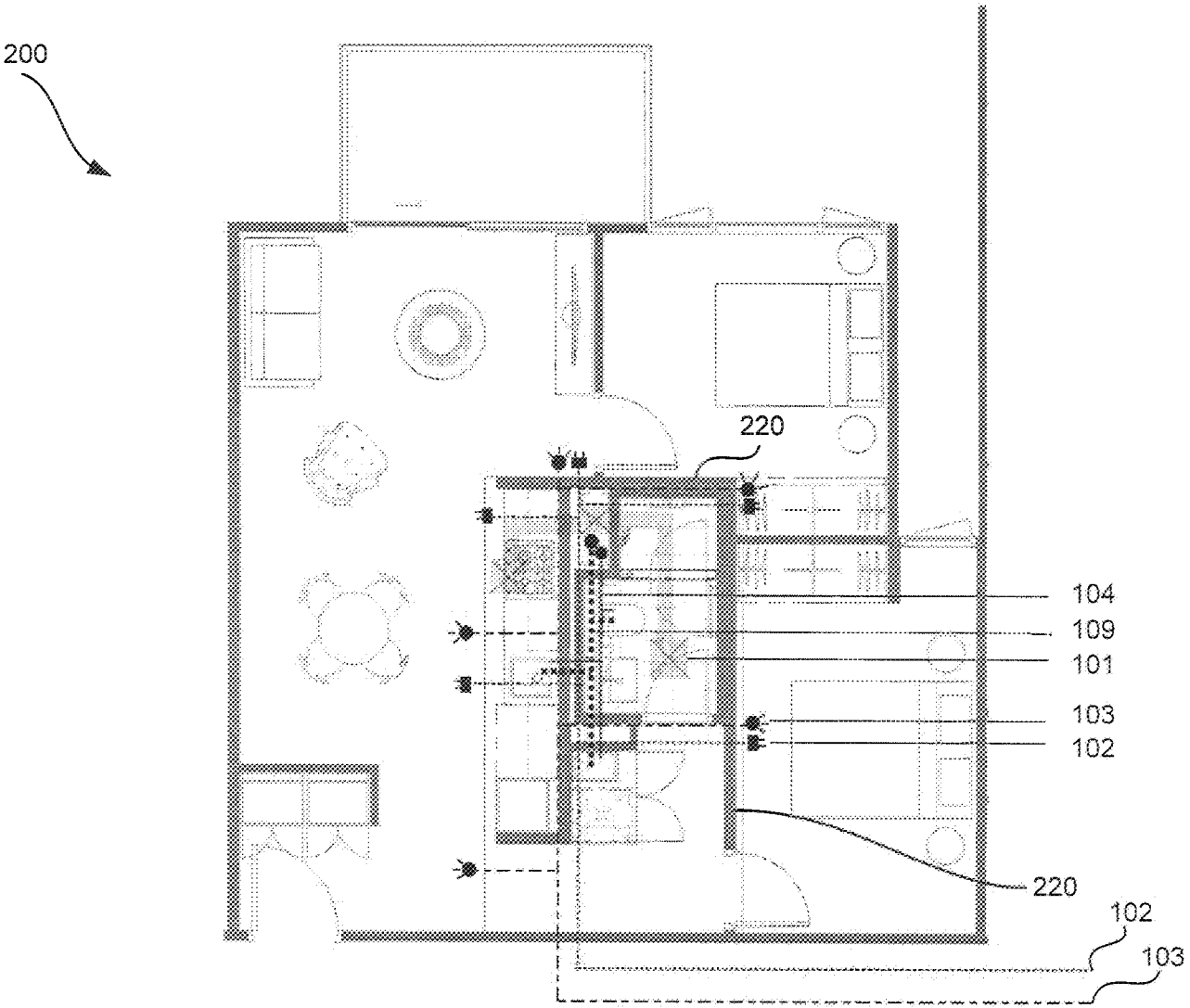
FIG. 15 is a floorplan of another apartment with a services overlay.
Figure 16A:
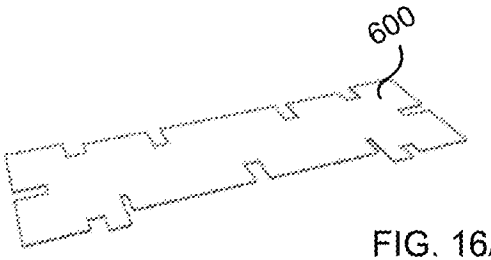
FIGS. 16A-I depict a building process in accordance with the present disclosure for constructing an apartment building.
Figure 16G:
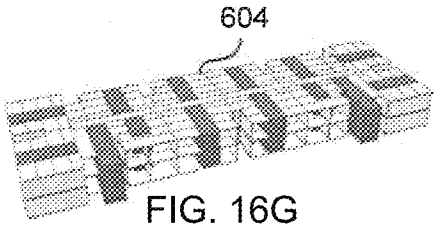
Figure 16H:
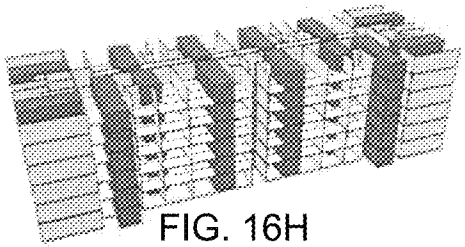
Figure 16I:
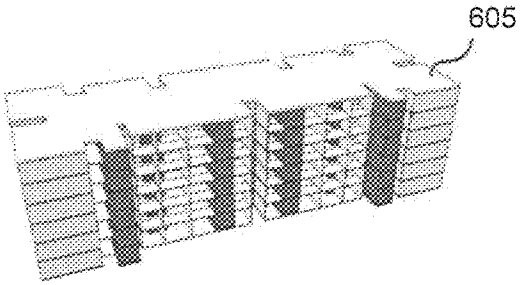
Figure 16D:
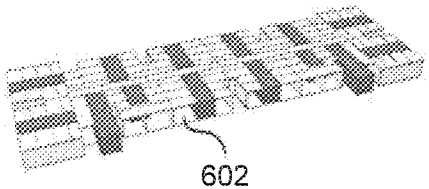
Figure 16E:
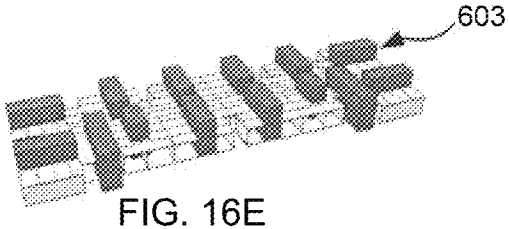
Figure 16F:
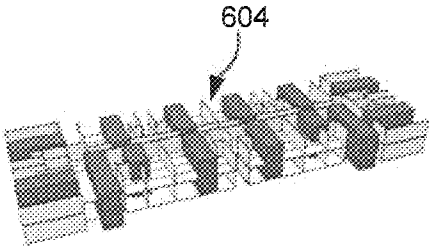
Figure 16B:
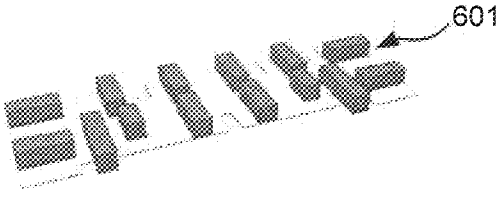
Figure 16C:
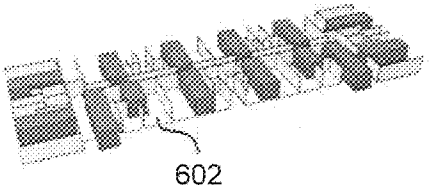

FIG. 15 is a services diagram for the apartment 200 of FIG. 13. Using the same reference numerals as previously, air extraction conduits 101, electricity cables 102, fire sprinkler pipes 103 and wastewater and sewerage pipes 104 are shown. In addition, water pipes 109 are also shown. As with the embodiment shown in FIG. 14, the services are concentrated in and around the building module 220. In one embodiment, the services are exclusively provided to an apartment by a prefabricated building module, which also contains the service-intensive fixtures of the apartment.

FIGS. 16A-I depicts an example of a staged process or constructing building. A foundation 600 is first laid. A first primary component layer 601 is then placed on the foundation 600. The prefabricated building modules forming the first primary component layer 601 may, for example, be one or a combination of the building modules previously described herein. A first secondary component layer 602 is then formed around the first primary component layer 601. The process is then repeated for a second primary component layer 603, a second secondary component layer 604 and so on until the required number of layers is constructed (see FIG. 16H). A roof 605 is then provided for the building.

As described above, the disclosed building modules including for example the building modules 110, 110A, 210, 210A, 310 and 410 provide gravitational and shear force stability to the building. In some embodiments, shear force stability may be increased through the use of reinforcement at particular locations. An embodiment in which this may be achieved is described with reference to FIGS. 17A to 20, which diagrammatically depict another embodiment of a building module 510. The building module 510 is similar to the building module 10 shown in FIG. 6A above, apart from the inclusion of reinforcement, the expansion of the module to include external side walls, an alternative means for connecting stacked modules and minor variations. The characteristics of the building module 510 to provide gravitational and shear force stability may also be applied to other embodiments of the building module disclosed herein.

Similar to the building module 10, building module 510 includes two primary load bearing walls: a vertical front side wall 513A and a vertical rear side wall 513B, which are spaced apart in a lateral direction of the building module 510, and extend parallel in a longitudinal direction of the building module 510. Two rectangular cut-outs 523A, 533A are formed in the front side wall 513A, which provide for doorways to allow access to the interior of the building module 510. Two rectangular cut-outs 5236, 5336 are formed in the rear side wall 513B, which also provide for doorways to allow access to the interior of the building module 510.

A space between upper edges of the front and rear side walls 513A, 513B is bridged by a horizontal roof 511, such that an upper face of horizontal roof 511 is offset to be slightly lower than upper edge faces of the front and rear side walls 513A, 513B. A ceiling (not shown) may be suspended below the roof 511 to form a services cavity between the ceiling and the roof 511, A horizontal floor 512 is spaced apart from the roof 511 in the vertical direction, and bridges a space between lower edges of the front and rear side walls 513A, 513B, parallel to the roof 511, such that a lower face of the floor 512 is flush with lower edge faces of the front and rear side walls 513A, 513B. This generally rectangular prism is capped at one end by a vertical left external wall 517A and at another end by a parallel vertical right external wall 517B. Upper and lower edge faces of the left and right end walls 517A, 517B are flush with the upper and lower edge faces of the front and rear side walls 513A, 513B, respectively.

Figure 21A:
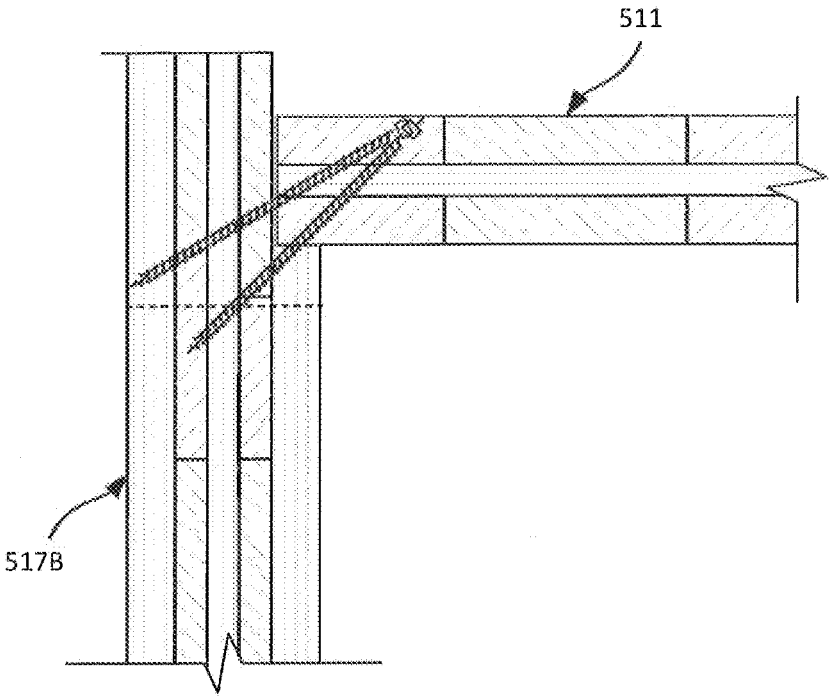
FIGS. 21A and 21B are enlarged view of areas A and B, respectively, in FIG. 20.
Figure 21B:
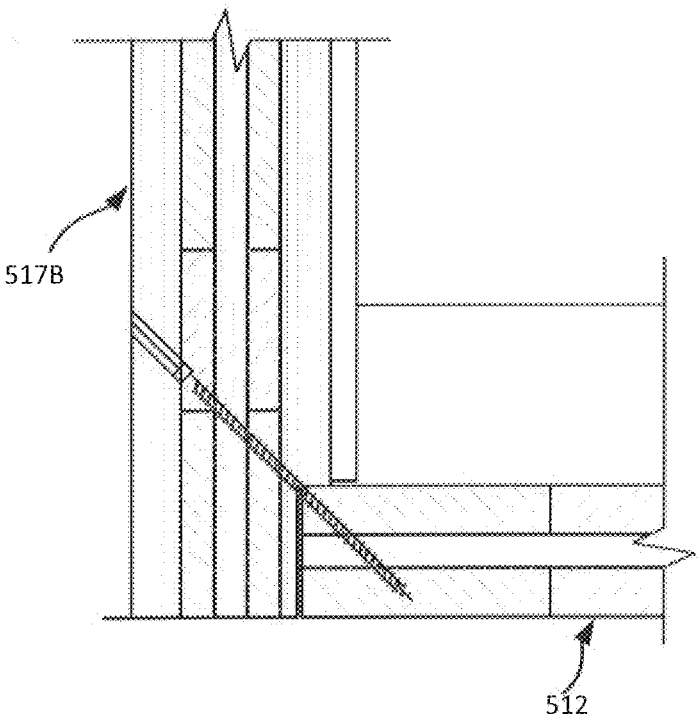

In this embodiment, the roof 511 is received in an internal rebate cut into the upper edge of the right end wall 517B and fixed to the right end wall 517B with coach screws as fixing means, as depicted in FIG. 21A. Similarly, the floor 512 is received in an internal rebate cut into the lower edge of the right end wall 517B and fixed to the right end wall 517B with coach screws as fixing means, as depicted in FIG. 21B. This rebate joint configuration may also be applied to the joints between the roof 511 and the floor 512 and the front and rear side walls 513A, 513B. It will be appreciated that other embodiments may utilise other joint configurations in which one or more of the rebates is not present, such as one in which the roof 511 and/or the floor 512 butts against one or more of the front and rear side walls 513A, 513B and/or the left and right end walls 517A, 517B.

Figure 22:
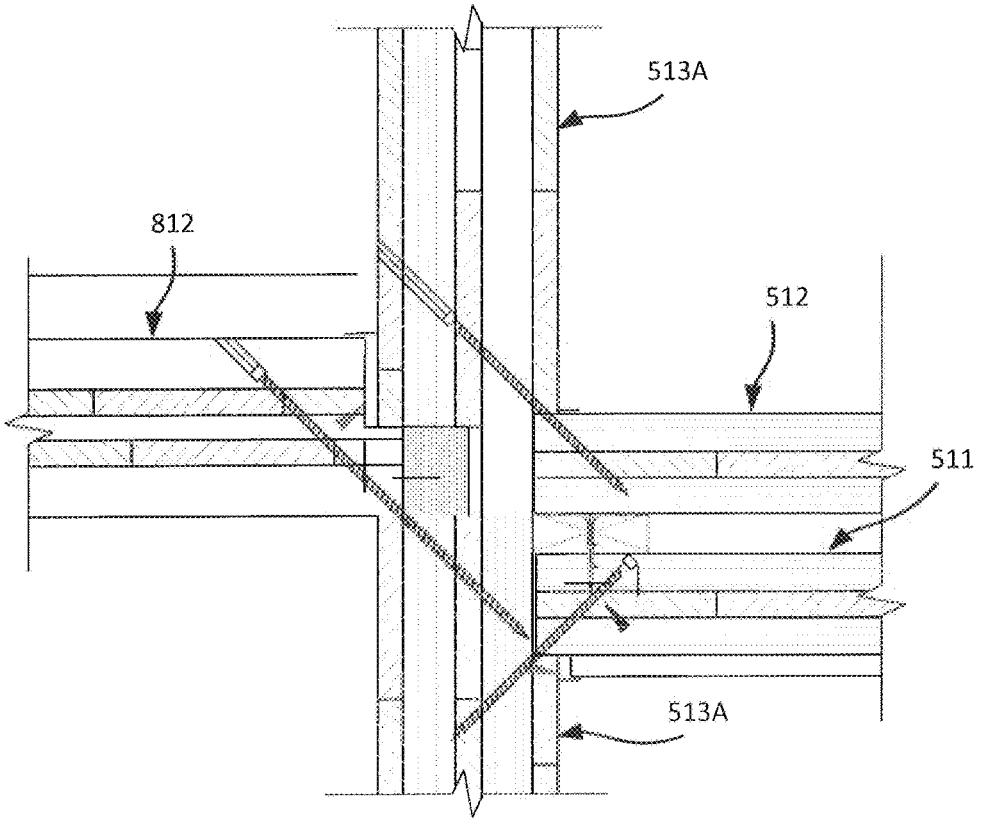
FIG. 22 is an enlarged partial vertical cross section depicting a joining system used to join an external floor to side walls of vertically abutting prefabricated building modules depicted in FIGS. 17A and 17B.

In some embodiments, a rebate joint configuration may be used to fix a secondary component to the one or more building modules as primary components. FIG. 22 is an enlarged partial vertical cross section depicting such a rebate joint configuration. The front side wall 513A of a first building module is fixed to the floor 512 with a coach screw as described above. The lower edge face of the front side wall 513A of the first building module abuts against the upper edge face of the front side wall 513A of a second building module, wherein the first building module is stacked on the second building module. The roof 511 of the second building module is fixed to the front side wall 513A of the second building module with a coach screw as described above, and a gap is formed between the roof 511 of the second building module and the floor of the first building module. An external rebate is cut into the lower edge of the front side wall 513A of the first building module, and an edge of an external floor 812 (e.g. a secondary component such as the floor of a living room or bedroom of an apartment in which the first building module is located) is received in the external rebate. A horizontal rebate is formed in the edge of the external floor 812 such that the shoulder of the external rebate in the front side wall 513A of the first building module sits in the horizontal rebate. The external floor is fixed to the front side wall 513A of the second building module with a coach screw.

The building module 510 may span the entire width of the apartment in which it is located. In this case, the left external wall 517A may form part of an exterior façade of the respective apartment and/or building. Accordingly, a large, central cutout 518 in the left external wall 517A may be provided to accommodate window in the building module 510. A narrow cutout 528 may extend horizontally above the large, central cutout 518, and may provide access to the services cavity for facilitating the entry and/or exhaust of air from an air conditioning system and/or an extraction fan. Similarly, the right external wall 517B may form part of the boundary wall to a common corridor, and may be provided with a cutout 538 that also provides access to the services cavity, to allow services to enter and exit the building module 510 from the common corridor.

In some embodiments, the side walls, roof, floor and external walls of the building module are CLT. In this embodiment, the front and rear side walls 513A, 513B utilise five layer CLT with a total thickness of 140 mm, the roof 511 and floor 512 utilise three layer CLT with a total thickness of 80 mm, the left external wall 517A utilises five layer CLT with a total thickness of 140 mm and the right external wall 517B utilises five layer CLT with a total thickness of 140 mm. As depicted in the cross-section of FIG. 20, two internal dividing walls 514A, 514B are provided in the building module 510 and utilise five layer CLT with a total thickness of 140 mm.

As was the case with the example described above with respect to FIG. 6A, it will be appreciated that the wall thickness of the load bearing walls, within the range of about 80-140 mm is substantially less than the thickness describe with reference to the prior art of about 300 mm. Similarly, depending on the requirements for the building and the selection of materials and number of load bearing columns, the thickness of the load bearing walls may be reduced down to about 60 mm, or increased to about 160 mm, 180 mm, 200 mm, 220 mm or 240 mm.

In this embodiment, the lateral (shear) load resisting ability of the front and rear side walls 513A, 513B is further increased by the inclusion of reinforcing parallel flange channel (PFC) sections 591A-595A, 591B-595B that extend the height of module 510 at appropriate locations. In this particular embodiment, five PFC sections 591A-595A, 591B-595B are provided in corresponding recesses in each of the front and rear side walls 513A, 513B. The location, number and size of the PFC sections may be varied in different embodiments. In order to provide load transfer between the reinforcing PFC sections and the front and rear walls 513A, 513B, each PFC section is fixed to the CLT of the respective front or rear side wall 513A, 513B with fixing means, such as screws, coach screws, bolts or coach bolts. In some embodiments, one or more of the reinforcing PFC sections may be fixed through the respective front or rear side wall 513A, 513B to the left or right external wall 517A, 517B, or even an internal wall. Each PFC section is capped at its upper end with an upper horizontal flange, and at its lower end with a lower horizontal flange.

Figure 17A:
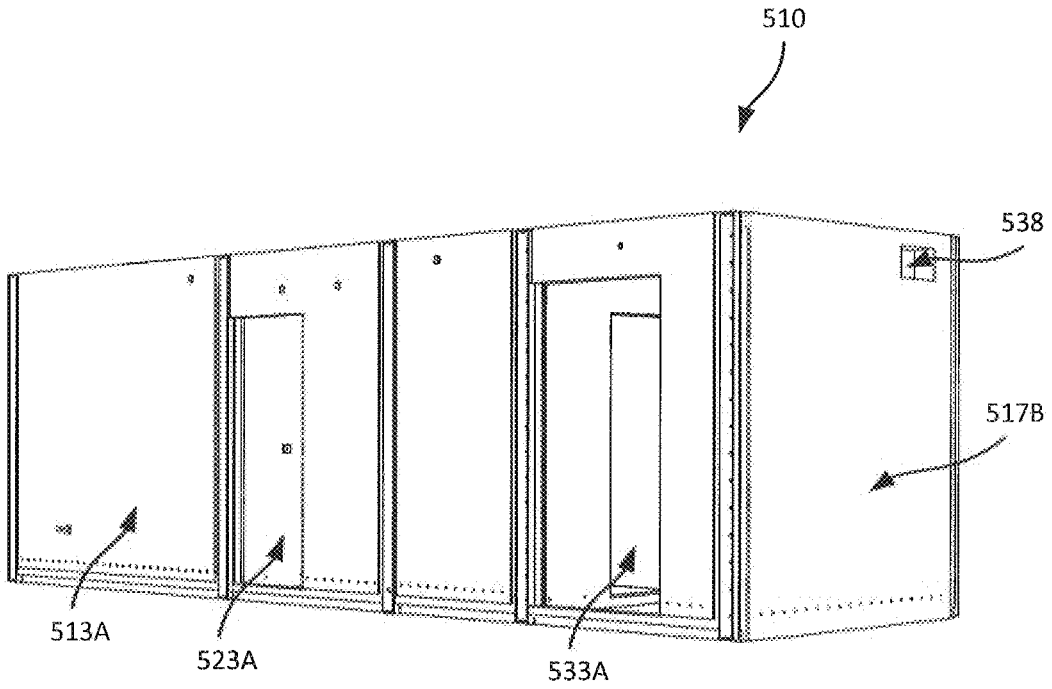
FIG. 17A is a front top perspective view and FIG. 17B is a rear top perspective view of an embodiment of a prefabricated building module in accordance with the present disclosure.
Figure 17B:
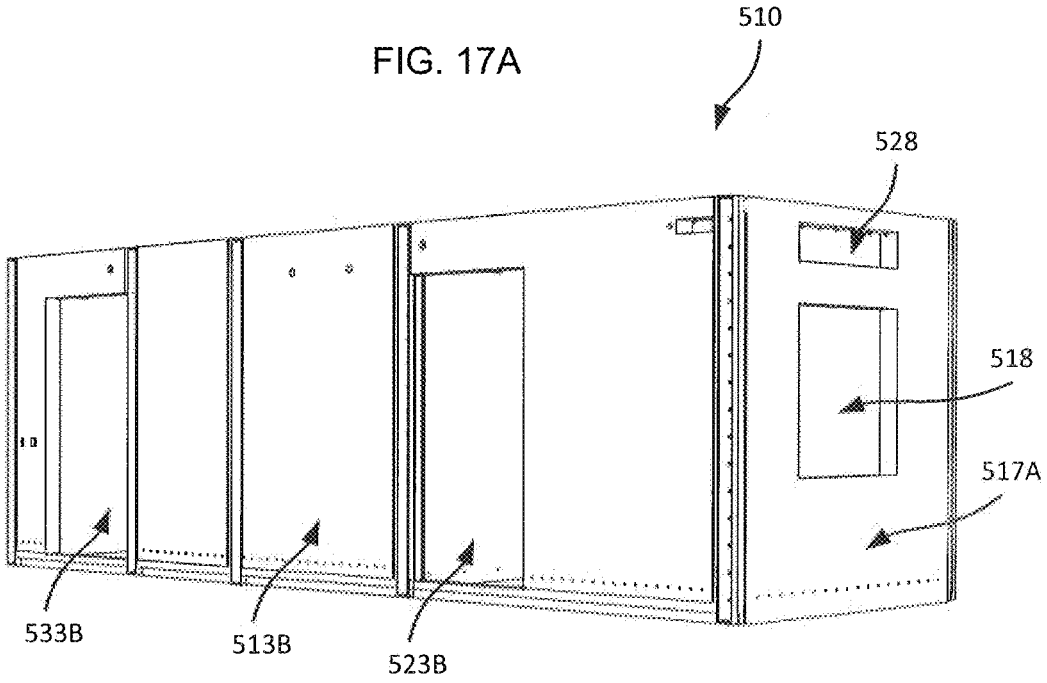
Figure 18A:
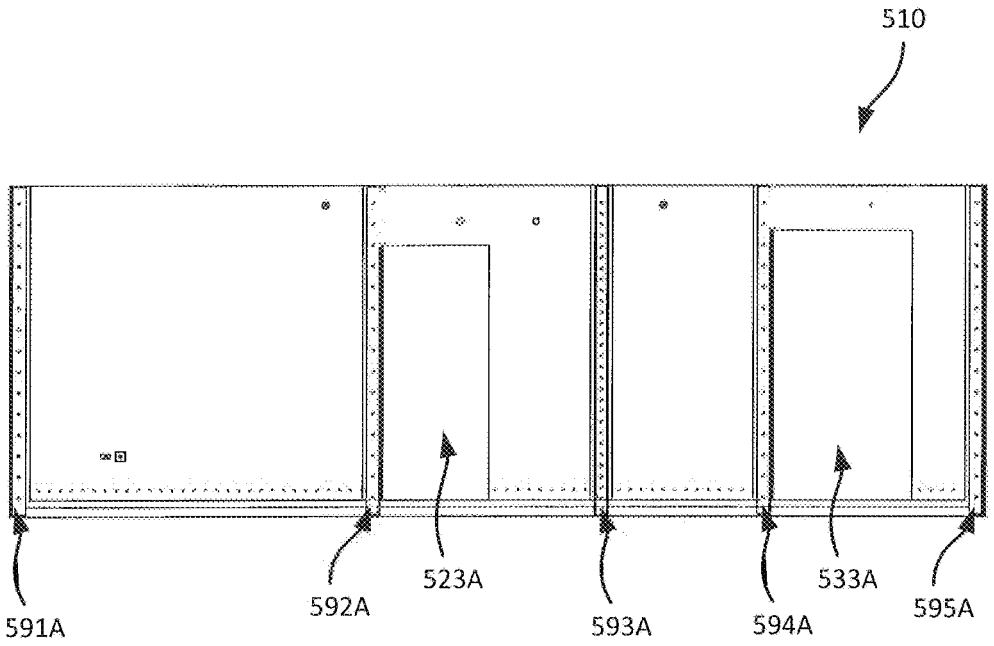
FIG. 18A is front elevation view and FIG. 18B is a rear elevation view of the prefabricated building module depicted in FIGS. 17A and 17B.
Figure 18B:
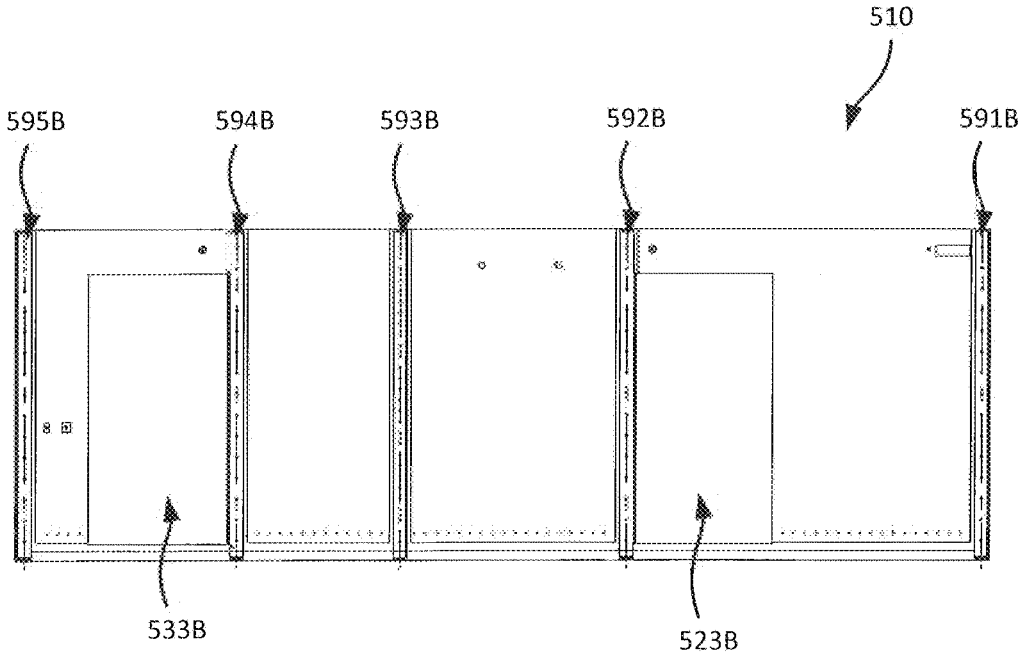
Figure 19:
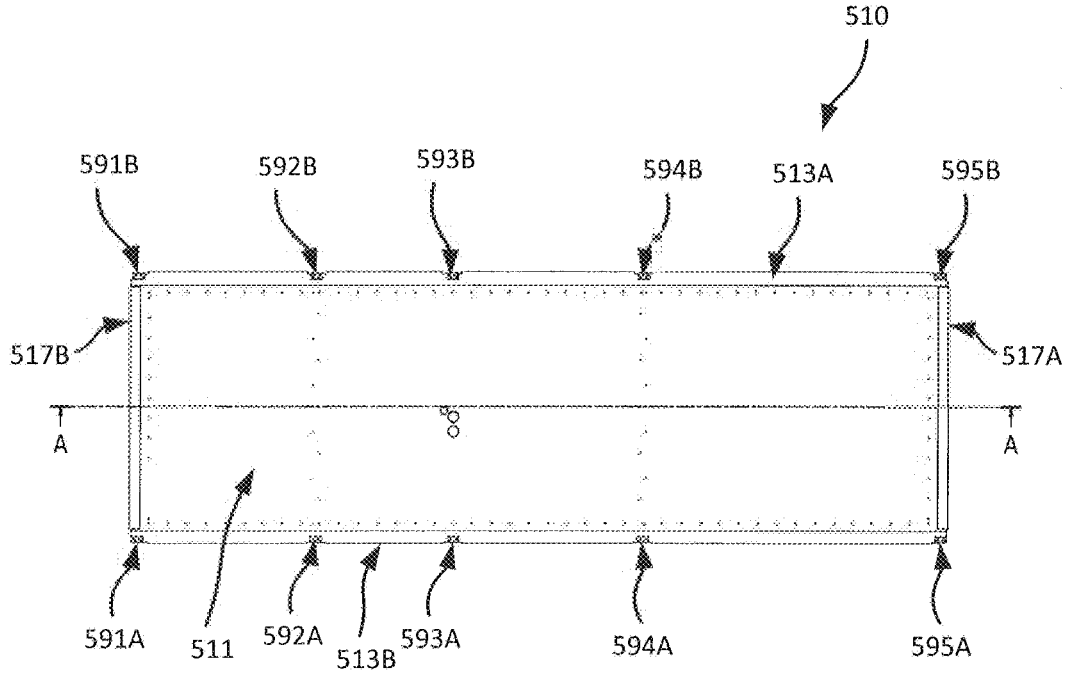
FIG. 19 is a plan view of the of the prefabricated building module depicted in FIGS. 17A and 17B.
Figure 20:
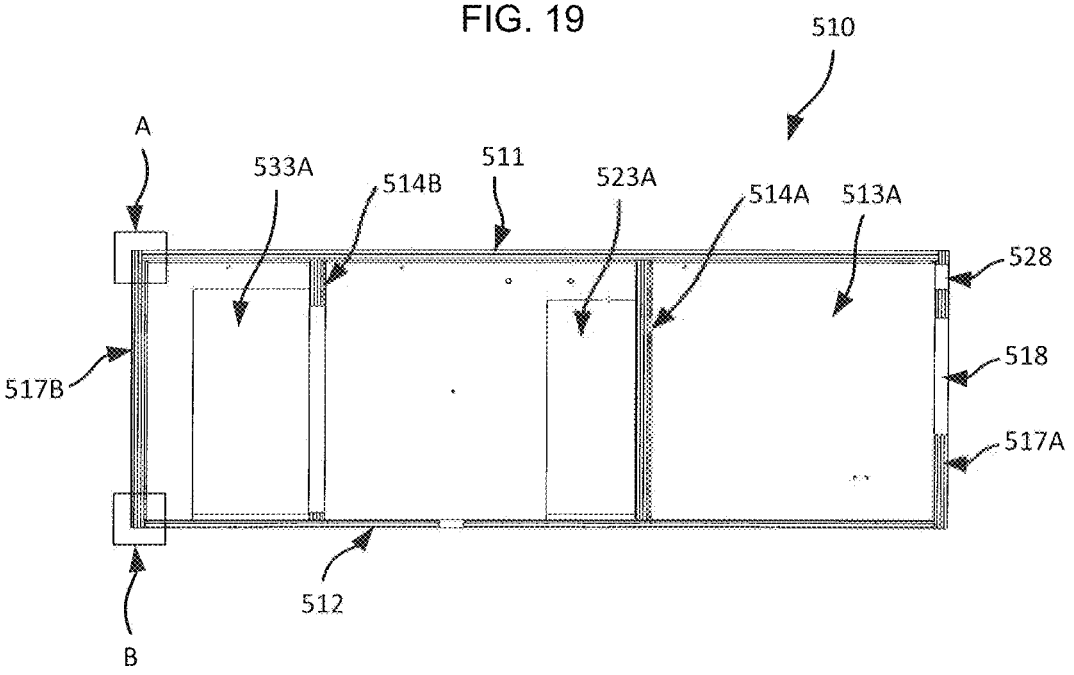
FIG. 20 is a cross-sectional view along the lines A-A in FIG. 19.

As depicted in FIGS. 17A and 18A, in the front side wall 513A, a front left PFC 591A is fixed in a recess in the left end, a front right PFC 595A is fixed in a recess in the right end, a front central PFC 593A is fixed in a substantially central recess, a front left intermediate PFC 592A is fixed in a recess between the front left PFC 591A and the front central PFC 593A, and a front right intermediate PFC 594A is fixed in a recess between the front right PFC 595A and the front central PFC 593A. As shown in FIGS. 17B, 18B and 19, in this particular embodiment, the locations of the PFC sections 591B-595B in the rear side wall 513B correspond to the locations of the PFC sections 591A-595A in the front side wall 513A to form five pairs of corresponding PFC sections. In addition, in this particular embodiment, the size and structural configuration of the PFC sections within a pair is identical. Such an arrangement can assist in ensuring that the building module provides a load transfer that is substantially symmetrical.

It will be appreciated that a substantially symmetrical load transfer may also be achieved even if the location, number and/or size of the reinforcing sections on the front side wall 513A do not precisely correspond to the location, number and size of the reinforcing sections on the rear side wall 513B. For example, a variation in the number of reinforcing sections may be compensated by a variation in the location and/or size of said reinforcing sections. It will also be appreciated that asymmetrical reinforcing arrangements may be appropriate in situations where asymmetrical load transfers are desired.

In the depicted embodiment, the left and right intermediate PFC sections 592A, 594A, 592B, 594B on both the front and rear side walls 513A, 513B are located adjacent the cutouts 523A, 523B, 533A, 533B. In this way, any reduction in gravity and shear force stability of the building module 510 due to the presence of the cutouts can be further ameliorated with the reinforcing of these left and right intermediate PFC sections. It will be appreciated that alternative locations of the left and right intermediate PFC sections 592A, 594A, 592B, 594B on both the front and rear side walls 513A, 513B may be more appropriate for other embodiments.

By providing each PFC section within a corresponding recess of the front and rear side walls 513A, 513B, the reinforcing does not protrude from the surface of said walls. Such an arrangement is depicted in FIG. 24, in which a coach screw is used to attach the rear left PFC 591B through the rear side wall 513B to the left end wall 517A, leaving the edges of the flanges of the rear left PFC 591B flush with the outer surface of the rear side wall 513B. Accordingly, it is possible to simply and easily apply a cladding to ensure a flush surface extends across the entire wall span.

By extending the entire height of the building module, the upper horizontal flange of each PFC section is exposed at the upper edge faces of the front and rear side walls 513A, 513B of the building module 510, and the corresponding lower horizontal flange is exposed at the lower edge faces of the front and rear side walls 513A, 513B of the building module 510. As such, when a first building module 510 is stacked directly on top of a second building module 510 with the same configuration, as depicted in FIG. 23A, or a complementary configuration allowing their respective PFC sections to align or substantially align, the upper horizontal flanges of the second building module 510 abut against and may be fixed to the lower horizontal flanges of the first building module 510 to form a continuous load bearing reinforcement across multiple stacked modules.

Figure 23A:
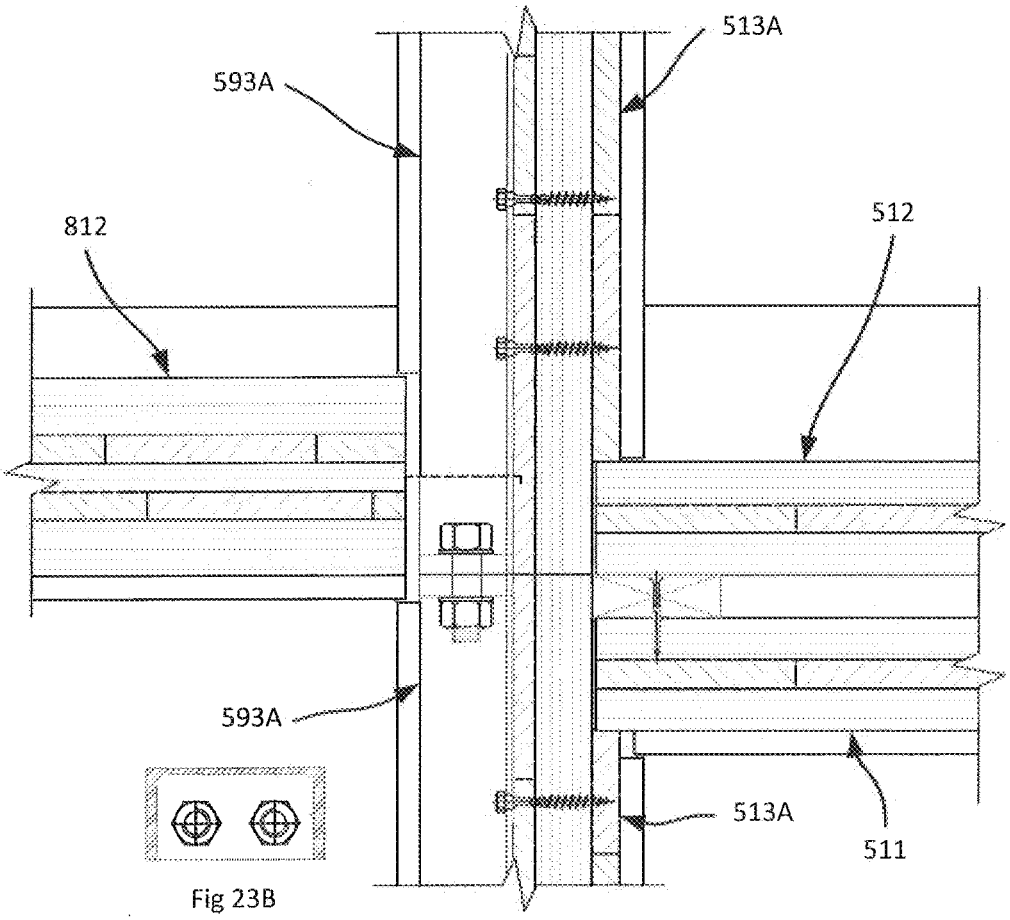
FIG. 23A is an enlarged partial vertical cross section depicting a joining system used to join side walls of vertically abutting prefabricated building modules depicted in FIGS. 17A and 17B.

FIG. 23A is an enlarged partial vertical cross section similar to that as depicted in FIG. 22. However, whereas the cross section of FIG. 22 is taken in a location where no reinforcing PFC section is present, the cross section of FIG. 23A is taken down the centre line of front central PFC sections 593A of the first and second building modules, wherein the first building module is stacked on the second building module. Apertures in the upper and lower horizontal flanges accommodate bolts as fixing means that fix the front central PFC section 593A of the first building module 510 to the front central PFC sections 593A of the second building module 510 to connect the two building modules together. Such a joining system may replace the joining system described above with respect to FIG. 6B.

Figure 24A:
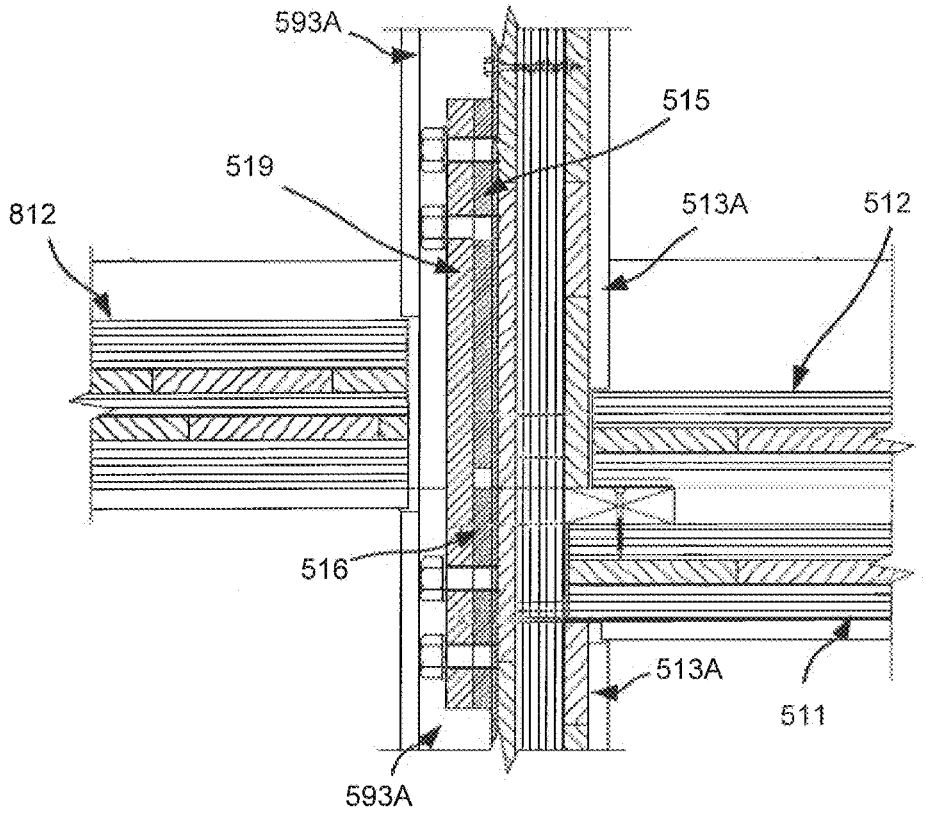
FIG. 24A is an enlarged partial vertical cross section depicting an alternative joining system used to join side walls of vertically abutting prefabricated building modules depicted in FIGS. 17A and 17B.
Figure 24B:
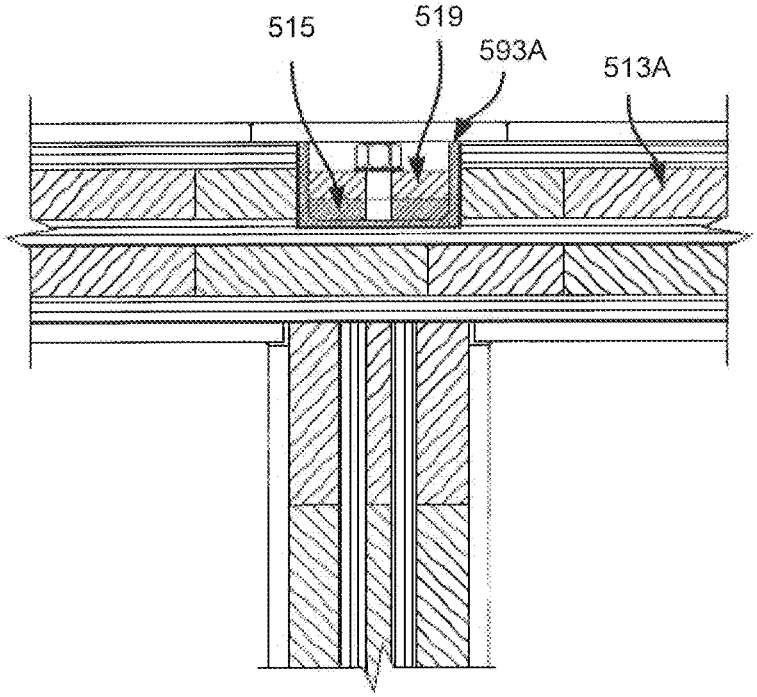
FIG. 24B is a horizontal cross section of the alternative joining system.
Figure 25:
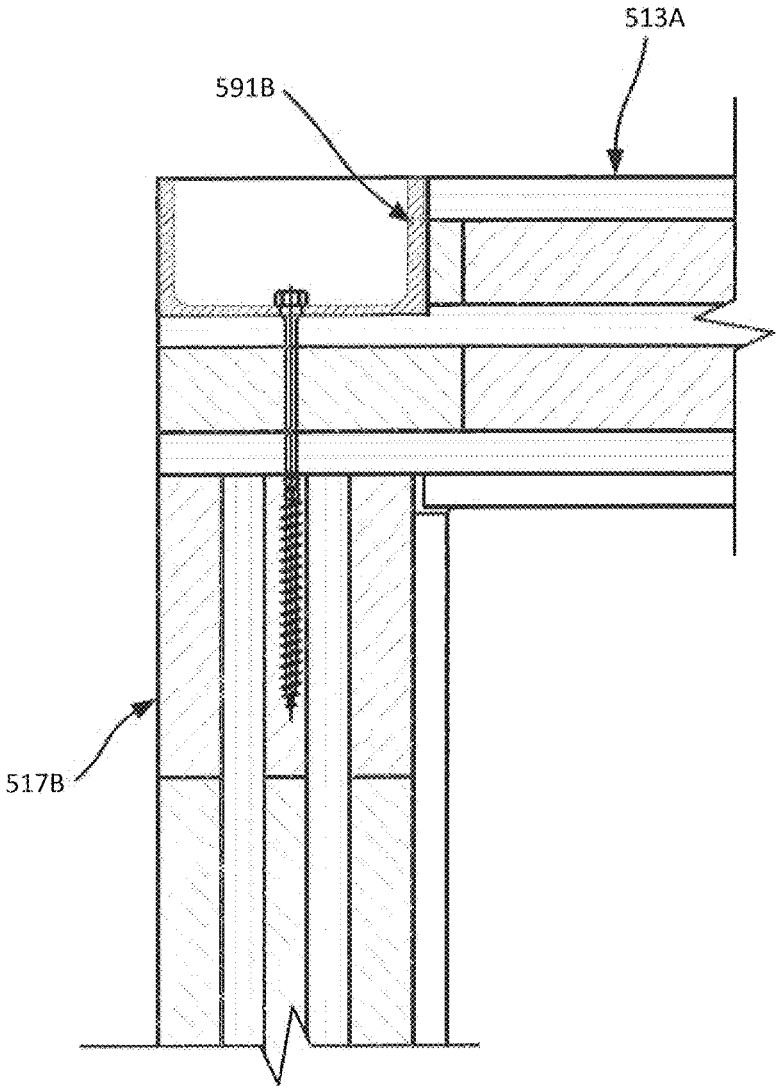
FIG. 25 is an enlarged partial horizontal cross section depicting a joining system used to join a side wall to an end wall.

Another alternative joining system is depicted in FIGS. 24A, and 24B. Similar to FIG. 23A, FIG. 24A is an enlarged partial vertical cross section taken down the centre line of vertically adjacent PFC sections, e.g. front central PFC sections 593A, of the first and second building modules, wherein the first building module is stacked on the second building module. FIG. 24B is a horizontal cross, section of the alternative joining system, depicting a portion of one of the internal walls.

A lower support plate 515 is welded to an inner side of the web at the lower end of the PFC section of the first building module, and a steel upper support plate 516 is welded to an inner side of the web at the upper end of the PFC section of the second building module. The lower and upper support plates 515, 516 are both steel plates having the same thickness (e.g. 15 mm), and each is provided with two threaded apertures for receiving bolts. These threaded apertures may be pre-formed before the plate is welded to the respective PFC section, or afterwards. In this embodiment, the lower support plate ends above the bottom of the PFC section of the first building module such that a gap is formed between the lower and upper support plates when the first building module is stacked on the second building module. Such a gap may provide a tolerance for differential settlement between the building modules. It will be appreciated that such a gap may not be necessary, or may be formed in alternative ways, e.g. the upper support plate 516 may end below the upper end of the PFC section of the second building module.

A steel stitch plate 519 extends from the lower support plate 515 of the first building module to the upper support plate 516 of the second building module. Four through holes are formed in the stitch plate 519 such that each through hole corresponds to one of the threaded apertures formed in the lower and upper support plates 515, 516. Bolts are inserted through each of the through holes of the stitch plate 519 and screwed into the corresponding threaded apertures to fix the stitch plate 519 to the lower and upper support plates 515, 516, and thereby connect the two building modules together. In some embodiments, the through holes may be oversized to allow for tolerances when bolting the stitch plate 519 to the upper and lower plates 515, 516.

In one embodiment, the upper and/or lower corners of the stitch plate 519 are bevelled or champfered. It will be appreciated that, in some embodiments, the stitch plate 519 may be bolted to one of the upper and lower plates 515, 516 before the first building module is stacked on the second building module. In these embodiments, the bevelled or champfered corners may assist with the insertion of the stitch plate 519 into the other of the upper and lower plates 515, 516, thereby facilitating alignment of the pods during the stacking process. It will be further appreciated that, in other embodiments, the stitch plate 519 may be welded to one of the upper and lower plates 515, 516, instead of bolted, before the first building module is stacked on the second building module. It will be understood that, in these embodiments, the threaded aperture in the respective upper or lower plate 515, 516, and the corresponding through holes in the stitch plate 519 may be omitted.

Figure 26:
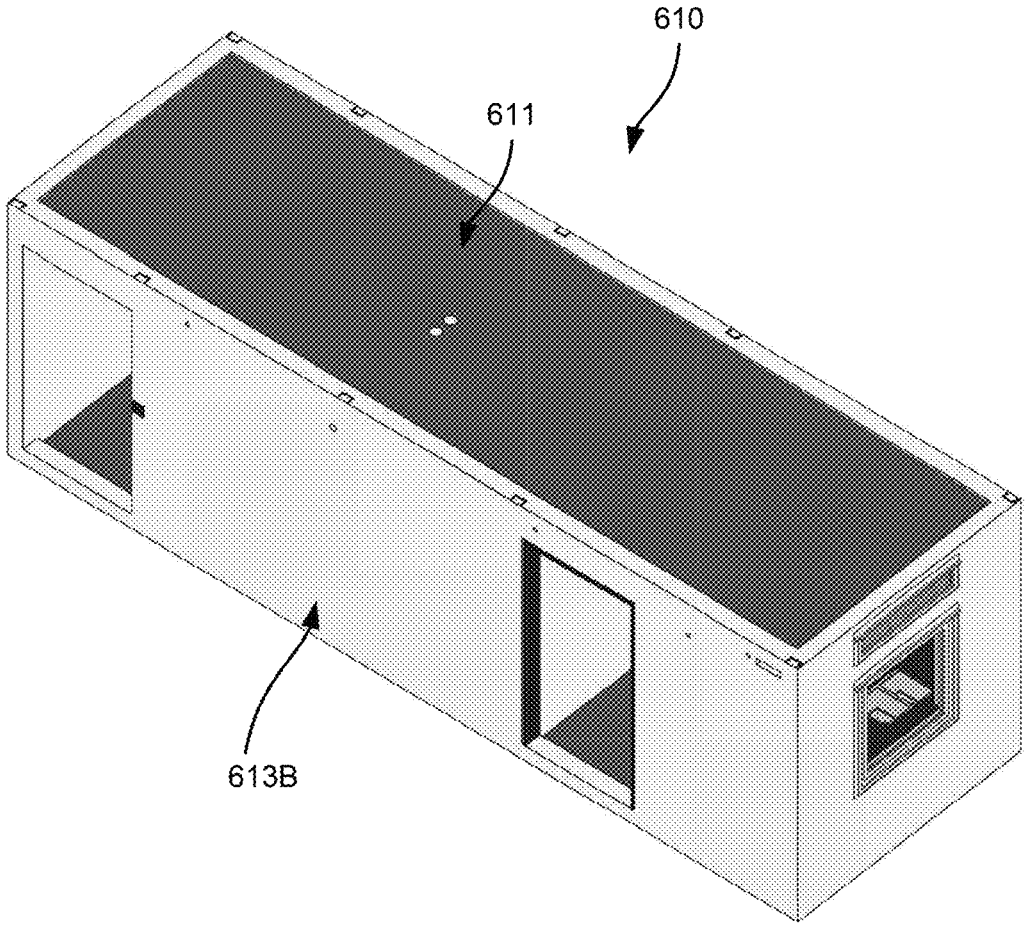
FIG. 26 is a rear top perspective view of an embodiment of a prefabricated building module in accordance with the present disclosure.

FIG. 26 is a rear top perspective view of another embodiment of a building module 610, which is substantially similar to the building module 510. Accordingly, like reference numerals will be used for like components. The differences between the two modules 510, 610 include the locations of the internal walls and the reinforcing PFC sections. Whilst the upper horizontal flanges are visibly exposed at the roof 611, a cladding has been applied to the front and rear walls 613A, 613B, and thus the remainder of each reinforcing PFC section is not visible.

Figure 27:
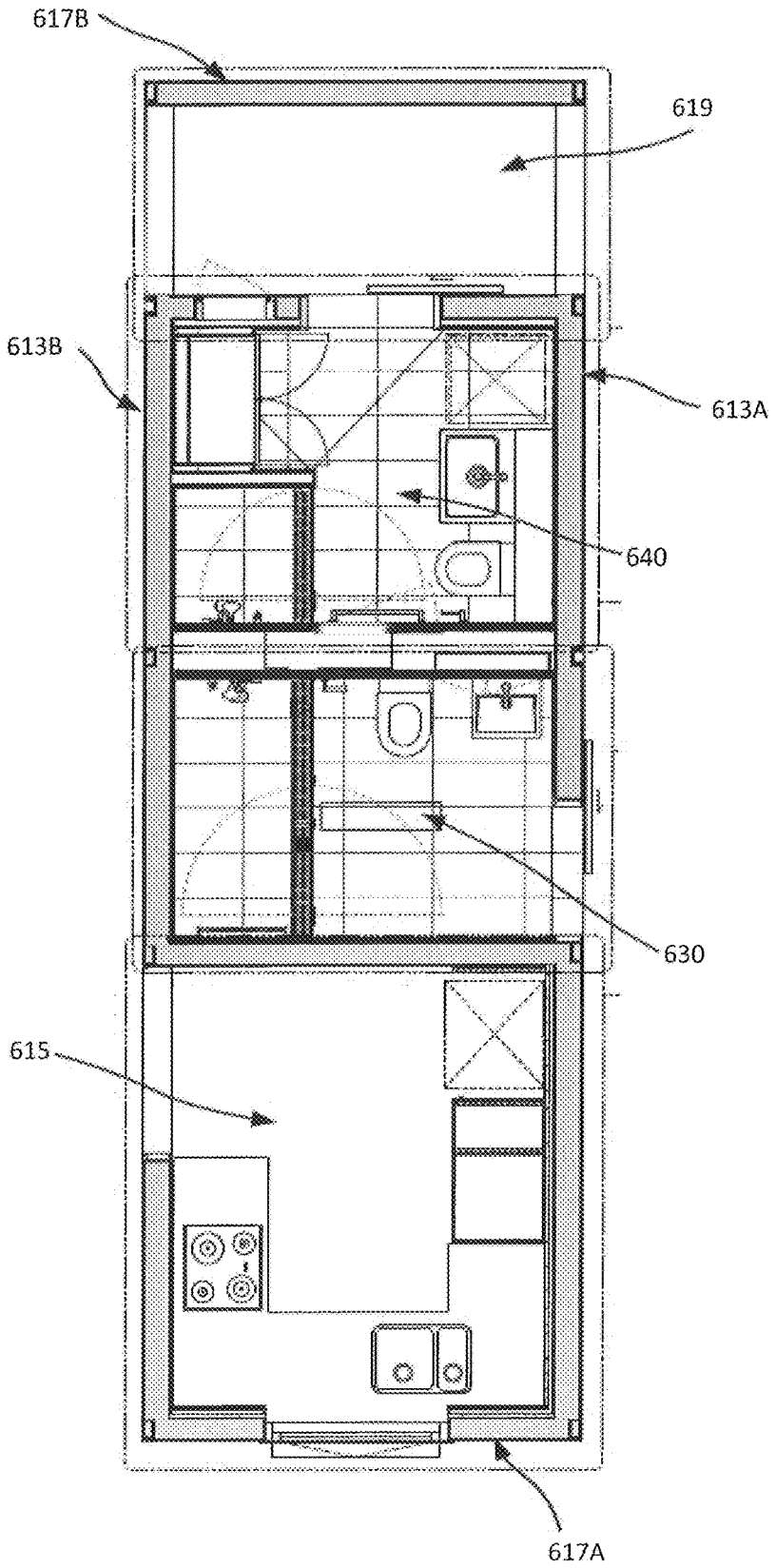
FIG. 27 is a floorplan of the prefabricated building module depicted its FIG. 25.

FIG. 27 is a floorplan depicting the specific arrangement of building module 610. The interior of this building module 610 is divided into a kitchen 615, an ensuite 630, a combined bathroom/laundry 640 and a hallway 619 by three internal walls 614A, 6146, 631. The location of the central and intermediate PFC sections corresponds to these three internal walls 614A, 614B, 631.

The hallway 619 extends across the entire width of the building module 610 at its right end. Cutouts are formed in the front and rear walls 613A, 613B to provide doorways that allow access to the hallway 619. A cutout is formed in the front wall 613A to provide a doorway that allows access to the ensuite 630, and a cutout is formed in the rear wall 614B. A cutout is provided in internal wall 614B to provide a doorway that allows access from the hallway 619 to the bathroom/laundry 640.

In this embodiment, internal wall 631 is not intersected by a services riser. Rather, internal wall 631 is provided with an integrated plumbing system (IPS), not shown, as is known in the art. For example, the IPS may be an off-the-shelf installation system such as the GIS installation system sold by Geberit. Such an IPS may distribute plumbing services from the services cavity between the ceiling and the roof 611 of the building module 610 to the fixtures within the ensuite 630 and bathroom/laundry 640, such as toilets, showers, vanity basins and washing machine taps and drains.

Internal wall 631 and/or the IPS may also include a hydraulic riser (not shown) for draining wastewater from the ensuite 630, the bathroom/laundry 640 and/or the kitchen 615. When one building module 610 is stacked directly on top of another building module with the same configuration, or a complementary configuration allowing their respective hydraulic risers to align or substantially align, the hydraulic risers communicate with each other to allow the wastewater from each building module to be drained vertically along the resulting riser column.

The ensuite 630 is in this embodiment laid out such that a toilet, a vanity basin and a shower cabin are provided backing on to the internal wall 631. This allows easy distribution of the plumbing services to these fixtures from the IPS.

A mini-IPS may also be provided to assist with the distribution of plumbing services. In this embodiment, the shower cabin in the bathroom/laundry 640 is provided backing on to the internal wall 631, as a mirror image of the shower cabin in the ensuite 630. A toilet and a vanity basin are provided so as to be arranged against the interior of the front side wall 613A rather than the internal wall 631, and washing machine taps and drains may be provided under the vanity basin. A mini-IPS is provided under the vanity cabinet to assist with distributing plumbing services to these fixtures from the IPS and connecting plumbing services to and from the washing machine taps and drains.

It will be appreciated by a person skilled in the art that internal wall 631, IPS and/or mini-IPS may be applied to building modules 110, 110A, 210, 210A, 310, 410 and 510 of the foregoing embodiments, to replace or augment the services riser 150, 217.

The kitchen 615 is provided between left external wall 617A and internal wall 614A. The kitchen 615 accommodates a kitchen benchtop that is provided with a stove and a sink. As left external wall 617A may be external to the building and may form part of the façade of the building, a large, central cutout in the left external wall 517A is provided in this embodiment to accommodate a window in the kitchen 615. A narrow cutout is provided above the large, central cutout, to provide access to the services cavity as well as facilitating the exhaust of air from a kitchen extraction fan.

Figure 28:
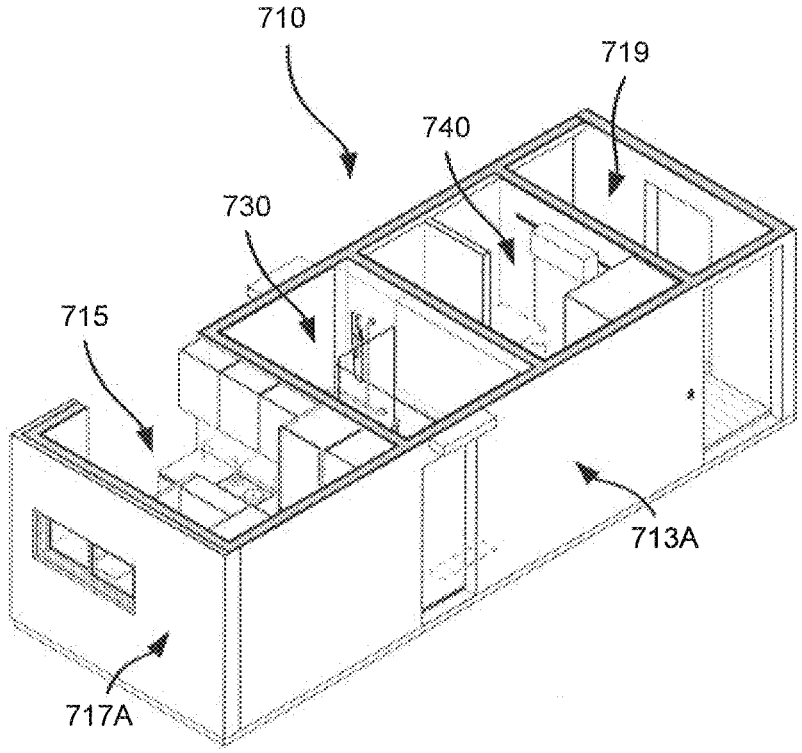
FIG. 28 is a front top perspective view of an embodiment of prefabricated building module in accordance with the present disclosure.
Figure 29:
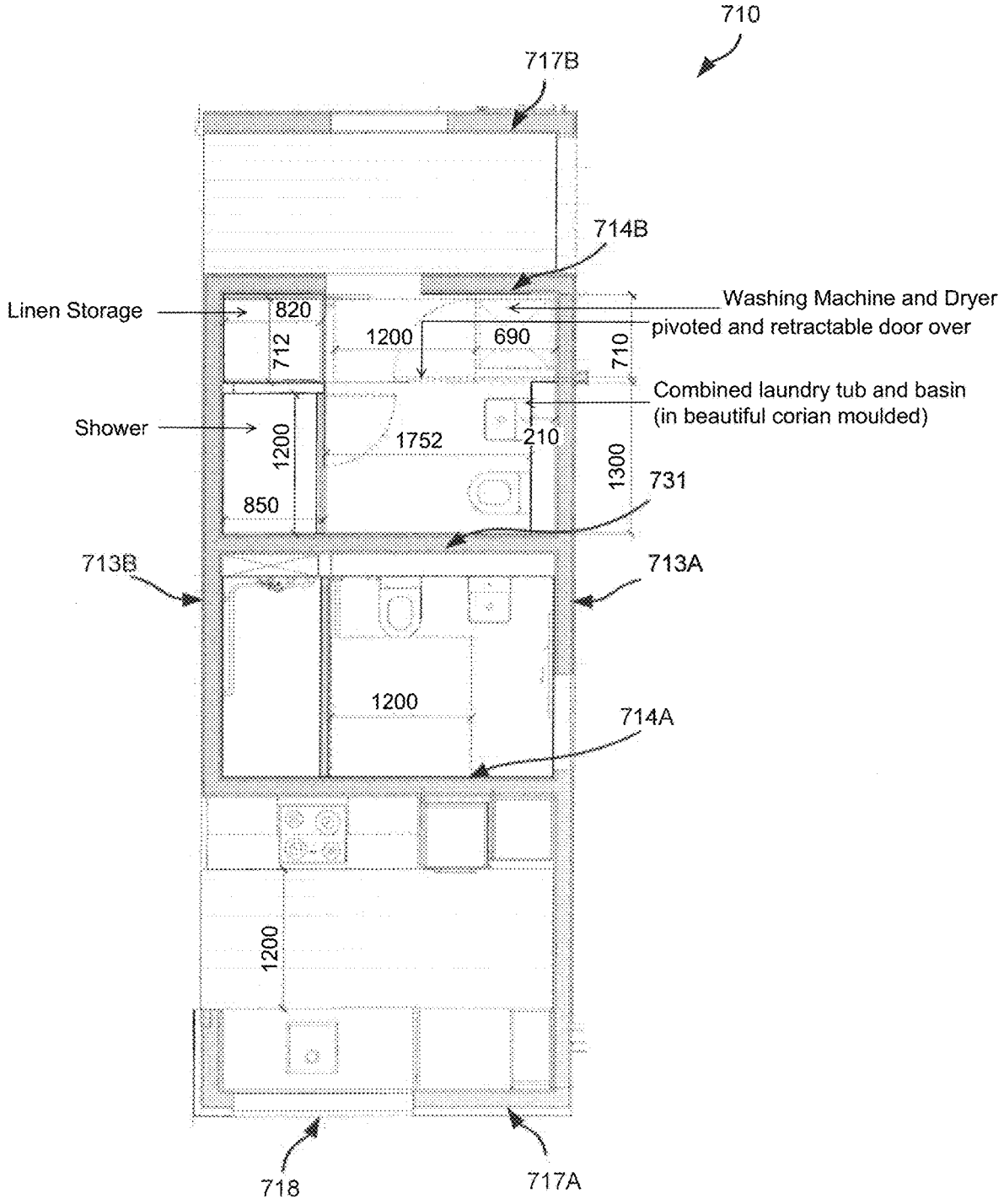
FIG. 29 is a floorplan of the prefabricated building module depicted in FIG. 28.

FIGS. 28 and 29 depict the specific arrangement of another embodiment of a building module 710, which may be the same as or similar to the building module 610. Accordingly, like reference numerals will be used for like components. FIG. 27 is a front top perspective view, having the roof and the ceiling cutaway. FIG. 29 is a floorplan. As was the case for building module 610, the interior of this building module 710 is divided into a kitchen 715, an ensuite 730, a combined bathroom/laundry 740 and a hallway 719 by three internal walls 714A, 714B, 731.

The differences between the two modules 610, 710 include the specific layout of the kitchen 715 provided between left external wall 717A and internal wall 714A. The kitchen 715 accommodates two kitchen benchtops, one that is provided with a stove and one that is provided with a sink. The large cutout 718 provided in the left external wall 717A is formed towards the rear of the module in this embodiment to accommodate, a window in the kitchen 715.

FIGS. 29A-J depict a prefabrication process in accordance with the present disclosure for assembling a prefabricated building module as depicted in FIG. 27.

Figure 30A:
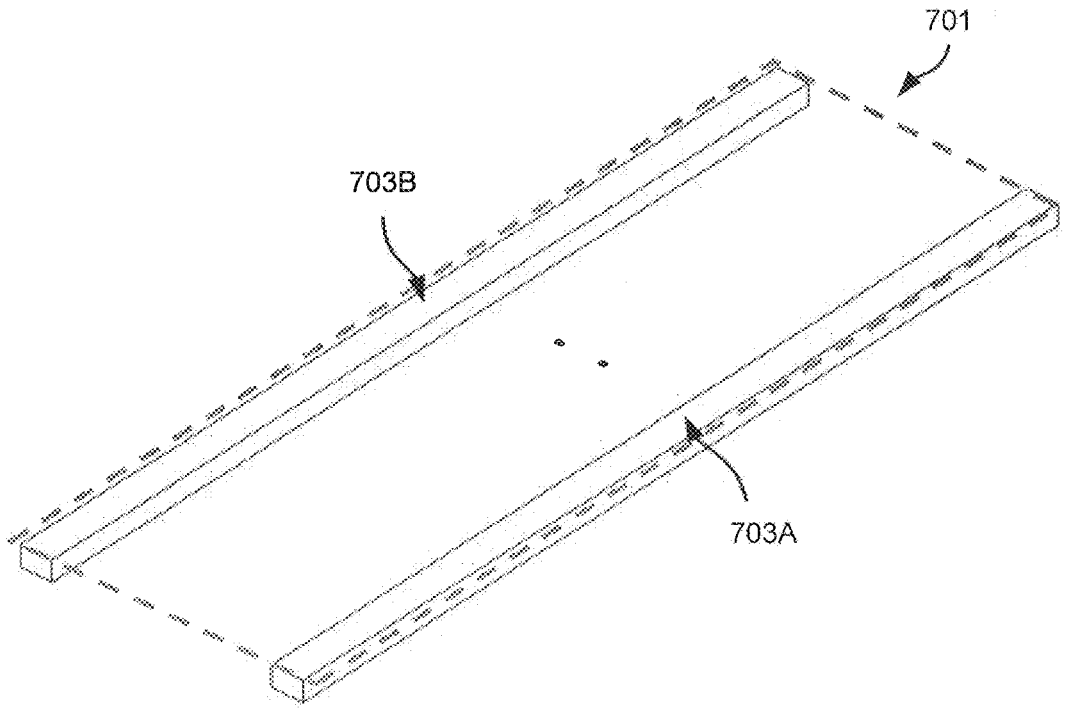
FIGS. 30A-J depict a prefabrication process in accordance with the present disclosure for assembling the prefabricated building module depicted in FIG. 28.
Figure 30B:
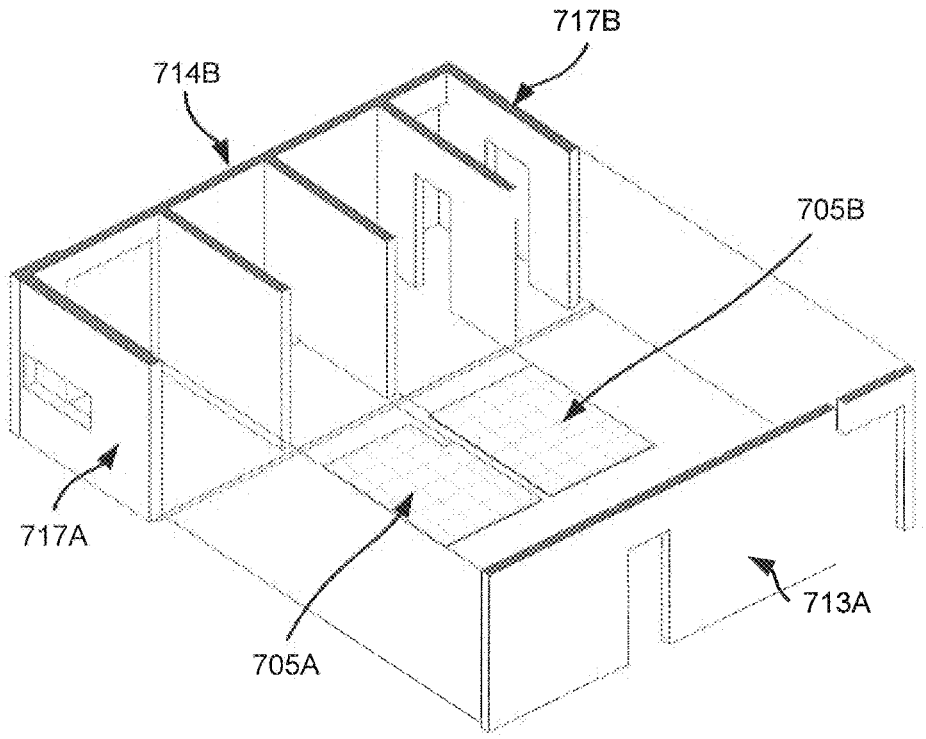

The prefabrication assembly process is carried out on a rail-like packer base 701 as shown in FIG. 30A, which allows access to the lower edges of the building module during the process. The rails 703A, 703B of the packer base 701 are sized to raise the lower edge of the building module to a height that maximises efficiency for the workers, and they are spaced apart at a distance that prevents or minimises bowing of the module floor 712 due to weight.

As shown in FIG. 30A, the floor 712 is first laid on the rails 703A, 703B of the packer base 701, and the rear wall 713B, the left and right external walls 717A, 717B and the three internal walls 714A, 714B, 731 are then assembled. In some embodiments, one or more of these walls may be formed from CLT pre-sheathed with drywall. In this embodiment, the front wall 713A and the roof 711 are not installed at this point in the process. It will be appreciated that deferring installation of one or more of the walls and the roof to a later point in the assembly process may assist in facilitating access to the internal spaces. In this embodiment, built-up floor tray assemblies 705A, 705B (with the required drainage fall) are then slid into the ensuite 730 and bathroom/laundry 740 from the front side of the building module, installed, waterproofed and finished in place before the front wall 713A is then installed.

Figure 30C:
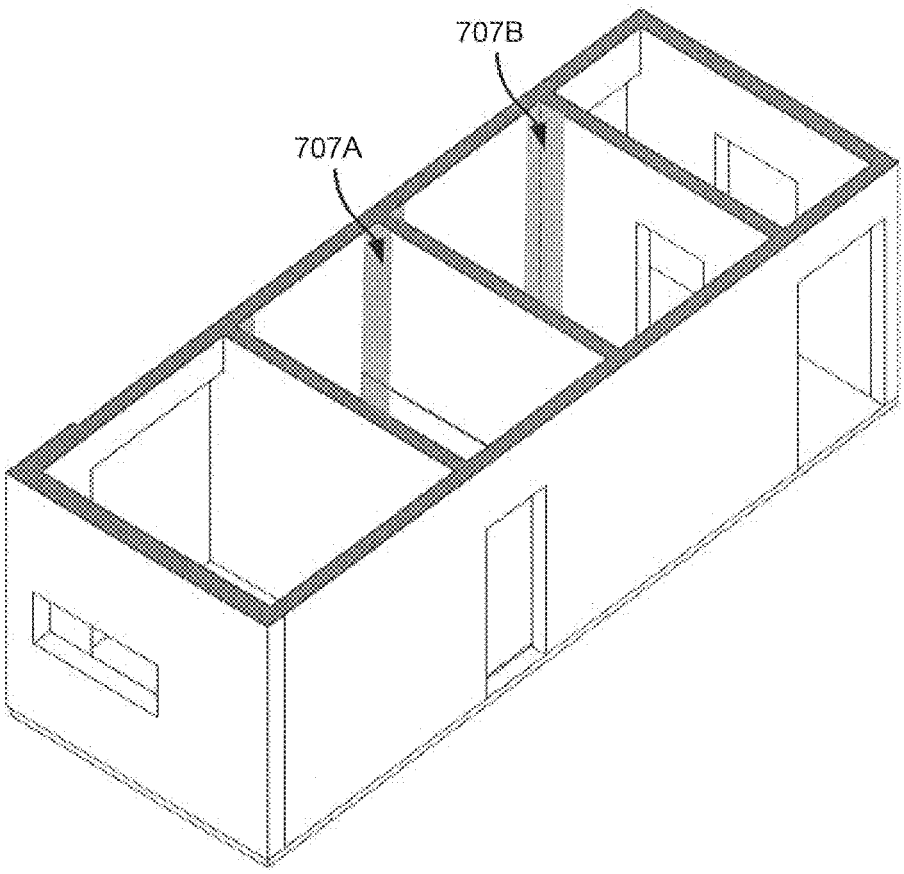

The walls in the wet areas of the ensuite 730 and bathroom/laundry 740 (e.g. the shower areas) are then waterproofed with a wall membrane taped at the corners with adhesive membrane tape 707A, 707B (see FIG. 30C). It will be appreciated, that, depending on the relevant building code requirements and the level of waterproofness of the wall surfaces, the wall membrane and/or adhesive membrane tape may be omitted.

Figure 30D:
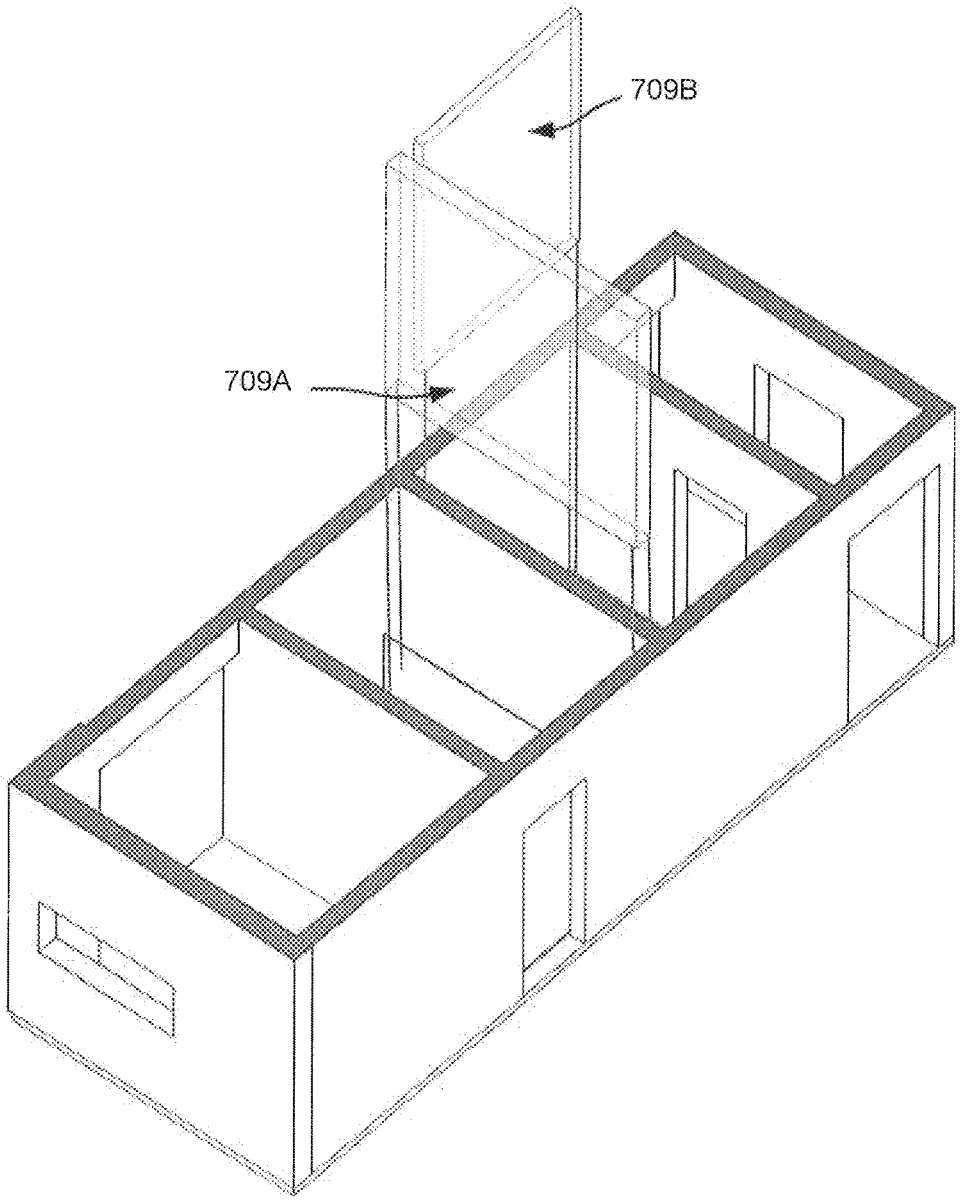

An IPS 709A, 709B is then installed for the plumbing in, each of the ensuite 730 and bathroom/laundry 740 (FIG. 30D). The IPS may include a hydraulic riser (not shown) for draining wastewater from the ensuite 730, the bathroom/laundry 740 and/or the kitchen 715. An instantaneous hot water unit (not shown) may be installed in one of more of the IPS. This installation may occur before or after the installation of the IPS in the ensuite 730 or bathroom/laundry 740. It will be appreciated that, in some embodiments, e.g. embodiments in which the wall membrane and/or adhesive membrane tape are omitted, the IPS may be installed at an earlier point in the assembly process, for example prior to the front wall being installed. In some embodiments, the IPS may form part of, or completely replace one of the internal walls.

Figure 30E:
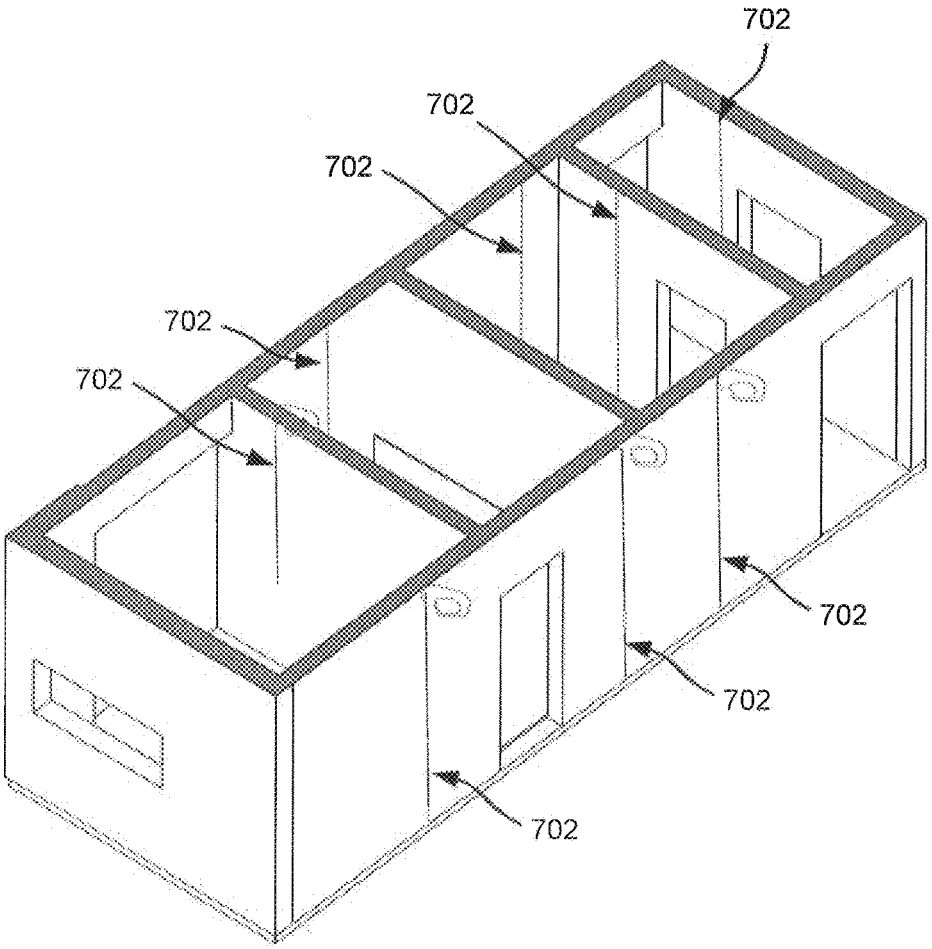
Figure 30F:
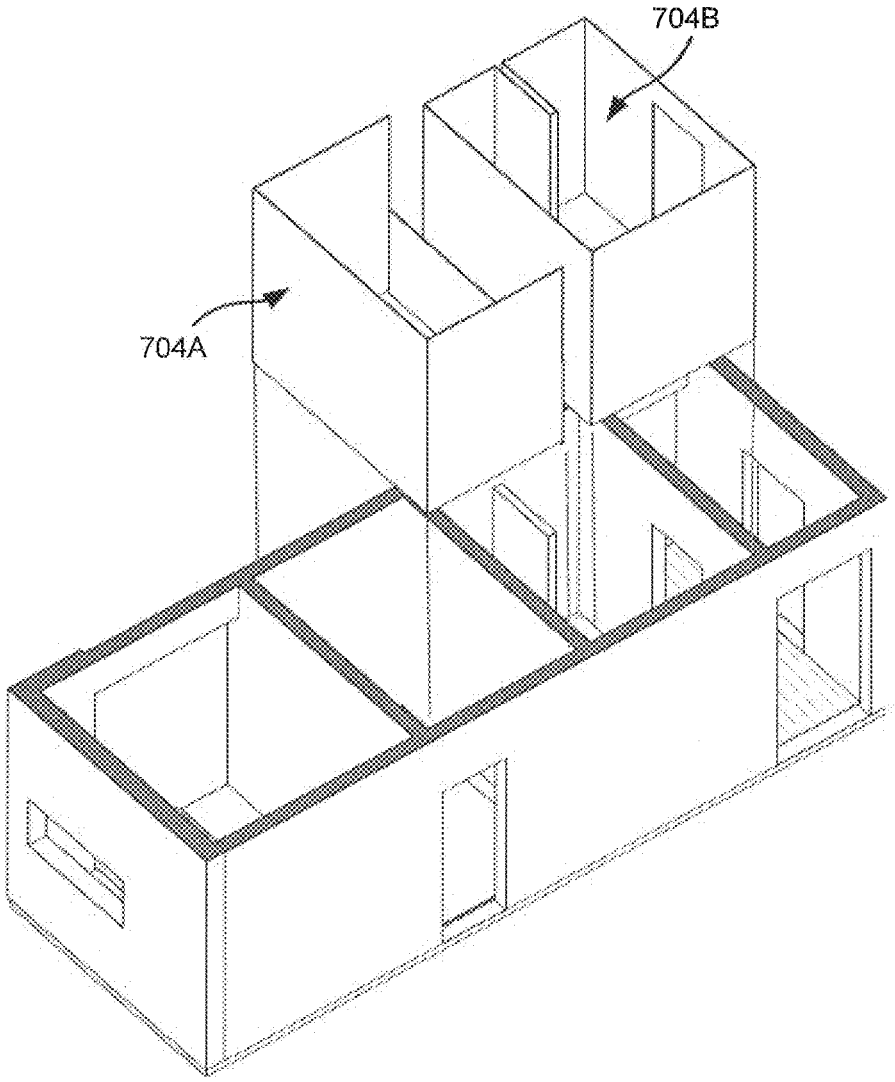

Electrical wiring 702 (including wiring for power, data, communication and security) is then installed in the walls of the building module. In this embodiment, the wiring 702 is reticulated through the CLT walls and spooled at the top of the building module for distribution as shown in FIG. 30E. The wall panels 704A, 704B for the ensuite 730 and bathroom/laundry 740 are then installed (FIG. 30F), with the installed panels overlapping the adhesive membrane tape and the upturn of the floor tray assembly.

The electrical wiring and respective conduits for other services (not shown), such as air-conditioning ducting and refrigerant piping, exhaust fans and ducting, fire sprinkler pipes and potable water, are then installed and distributed across the top of the building module, for example in a space that will become the services cavity. In some embodiments, two or more of these service conduits may be aggregated together during installation, such as in a pre-fabricated ceiling tray (not shown), or prior to installation in a pre-fabricated manner.

Figure 30G:
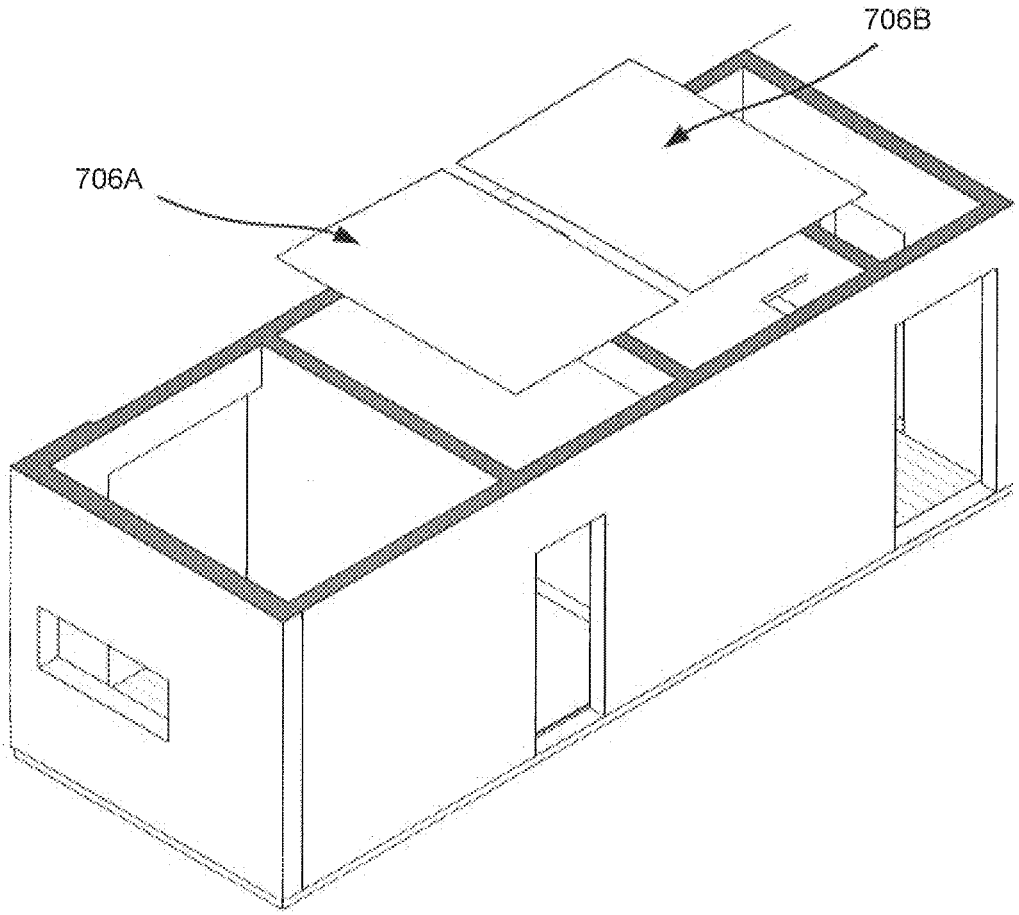
Figure 30H:
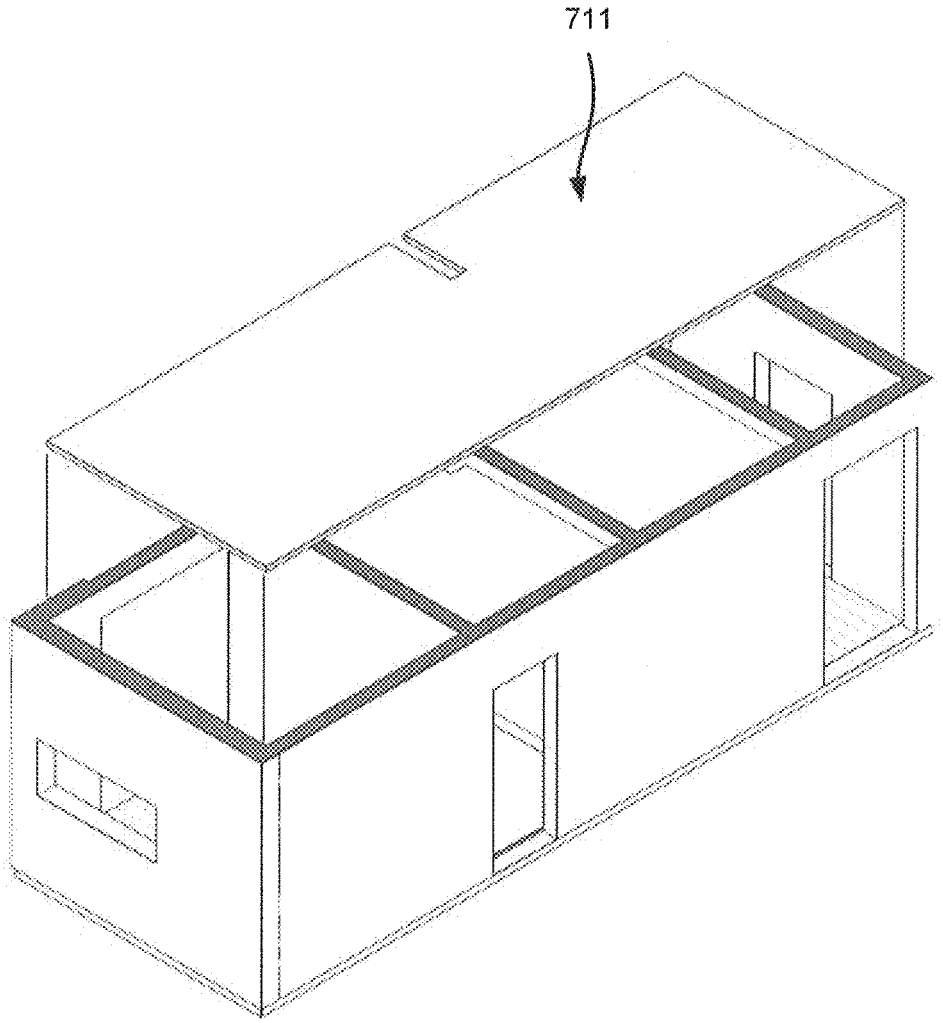
Figure 30I:
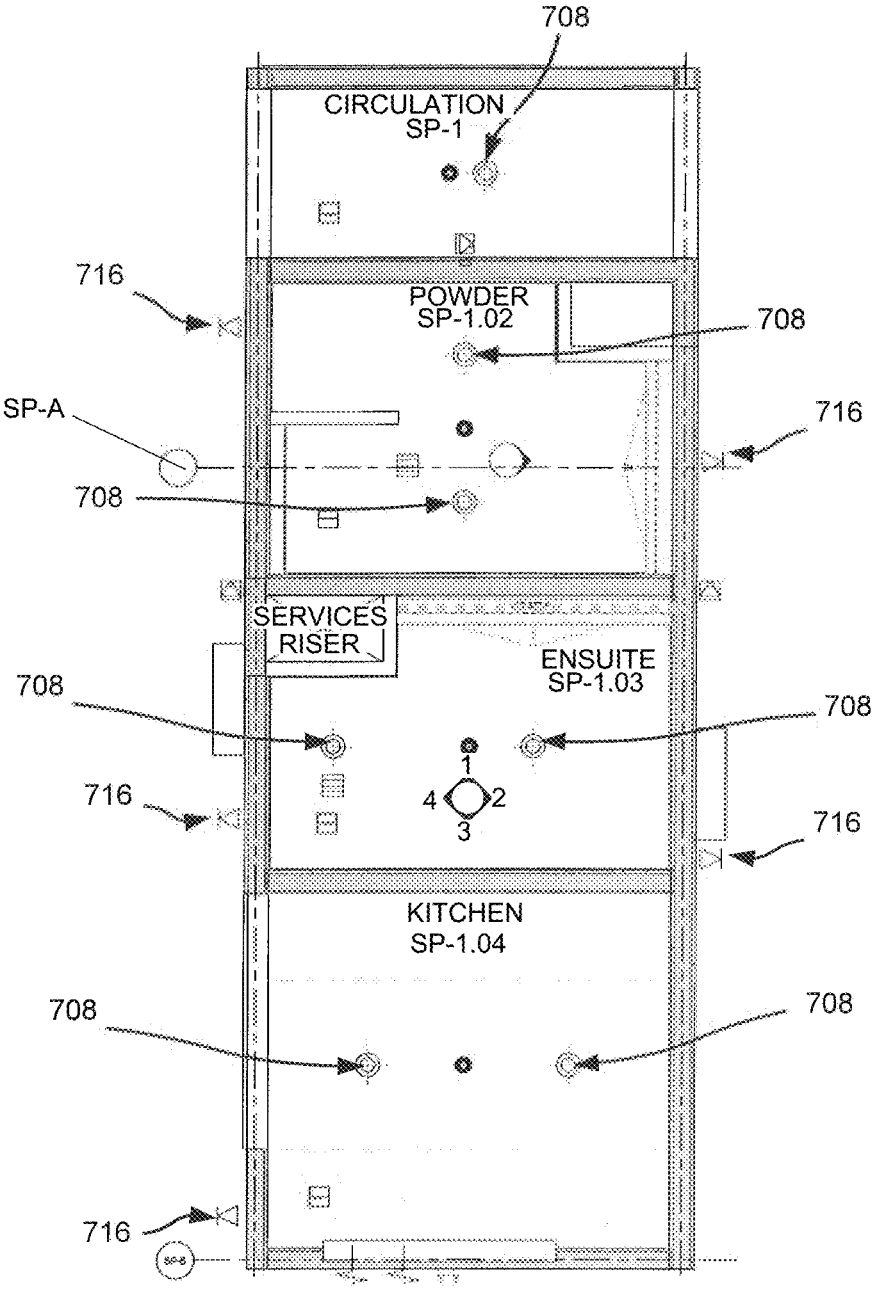

The ceiling is then installed from below, FIG. 30G depicts the installation of the ceiling 706A, 706B in the ensuite 730 and bathroom/laundry 740. In some embodiments, the ceiling may comprise a split batten or similar system, as is known in the art. This may decrease installation time, by avoiding plasterboard setting time. The roof 711 is then fitted to the top of the building module, as shown in FIG. 30H The electrical fittings internal and external to the building module, such as light fittings 708, switches (not shown) and general power outlets (GPO) 716, are then installed. FIG. 30I depicts the light fittings 708 as internal to the building module and the GPOs 716 as external. It will be appreciated that, in other embodiments, one or more light fittings may be provided external to the building module and one or more GPOs may be provided internal to the building module, in addition to or as a replacement of one or more of the depicted light fittings 708 and GPOs 716.

Figure 30J:
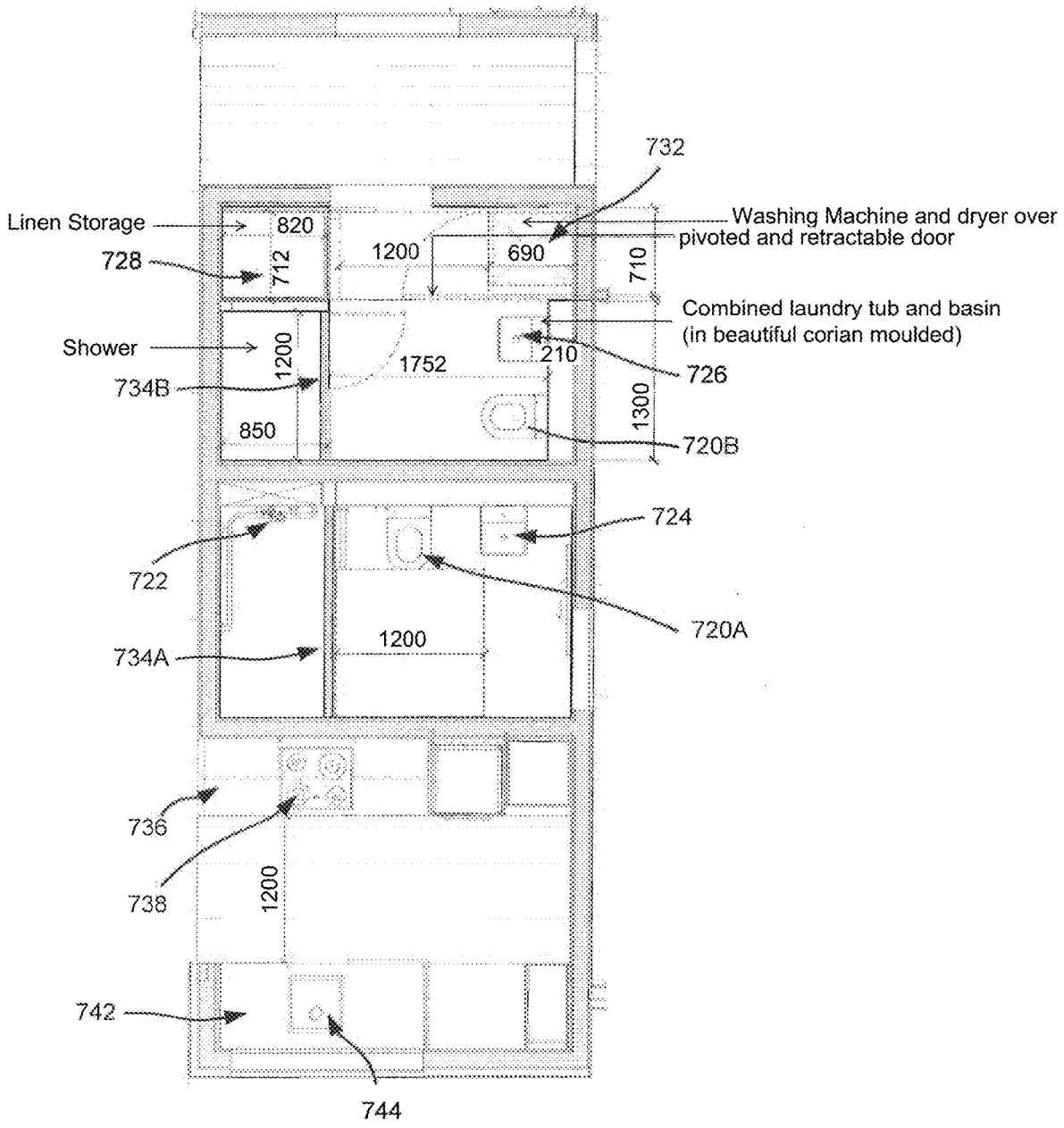

The fixtures, fittings and cabinetry internal to the building module are then installed, as shown in FIG. 30J. The ensuite 730 and bathroom/laundry 740 are each provided with a toilet 720A, 720B, a toilet roll holder (not shown), a shower head 722 (not shown in bathroom/laundry 740) and towel racks (not shown). A vanity basin 724 and taps (not shown) are installed in the ensuite 730, and a combined laundry tub and basin 726 with laundry taps (not shown) are installed in the bathroom/laundry 740. A mirror cabinet (not shown) may be installed in the ensuite 730, and a linen cupboard 728, a laundry cupboard 732 and a bench top (not shown) are installed in the laundry 740, before glass shower screens 734A, 734B are installed in the ensuite 730 and bathroom/laundry 740.

The kitchen is provided with a benchtop 736 installed against the internal wall 714A, which is fitted with a stove 738, a benchtop 742 installed against the left external wall 717A, which is fitted with a sink 744. Various forms of cabinetry are installed to provide storage space, such as a pantry and kitchen cabinets, whilst a cavity is provided to receive a refrigerator.

Each of the services and respective fittings of the building module are then tested to ensure they are all in working order, e.g. GPOs, light switches, taps, shower head, toilet, drain and exhaust fan. The fire sprinklers are also tested at this point, as is the waterproofness of the wet areas. The doors/jambs are then installed, all residue of the assembly process is then cleaned out of the assembled building module, and any remaining unsealed joints are finally sealed.

The completed, assembled building module 710 is then subjected to a quality control and certification process, before it is wrapped ready for shipping to the construction site.

The foregoing description includes a number of example embodiments. Individual features from different embodiments may be combined in other ways to form additional useful embodiments. These additional embodiments are intended to be within the disclosure of this document, as well as embodiments incorporating equivalents to the features disclosed.

As used herein, except where the context requires otherwise, the term "comprise" and variations of the term, such as "comprising", "comprises" and "comprised", are not intended to exclude further additives, components, integers or steps.

Reference to any prior art in the specification is not an acknowledgment or suggestion that this prior art forms part of the common general knowledge in any jurisdiction or that this prior art could reasonably be expected to be understood, regarded as relevant, and/or combined with other pieces of prior art by a skilled person in the art.

The invention claimed is:

1. A prefabricated building module for a building structure, wherein said prefabricated building module comprises:

at least one wall section of cross-laminated timber extending vertically between the upper and lower peripheral edges of the prefabricated building module, wherein a cross-laminated timber of the at least one wall section of cross-laminated timber extends vertically from the upper peripheral edge to the lower peripheral edge of the prefabricated building module, wherein said at least one wall section of cross-laminated timber is reinforced with at least one elongated structural section extending vertically from the upper peripheral edge of the prefabricated building module to the lower peripheral edge of the prefabricated building module, and said at least one elongated structural section is at least one parallel flange channel (PFC) section, and wherein the prefabricated building module is configured to be securable in a stack of a plurality of prefabricated building modules so that one or more resulting columns of said cross-laminated timber of the at least one wall section of cross-laminated timber acts as a loadbearing structure for the building structure.

2. The prefabricated building module according to claim 1, wherein said at least one parallel flange channel (PFC) section is provided in a recess formed in an outer surface of the at least one wall section of cross-laminated timber that is reinforced with at least one elongated structural section.

3. The prefabricated building module according to claim 1, wherein the prefabricated building module is configured such that, when the prefabricated building module is secured in a stack of like prefabricated building modules, one or more resulting columns of said parallel flange channel (PFC) sections act as a loadbearing structure for the building structure.

4. The prefabricated building module according to claim 3, including a floor of cross laminated timber prefabricated building module.

5. The prefabricated building module according to claim 4, including a roof of cross laminated timber prefabricated building module.

6. The prefabricated building module according to claim 5, including a ceiling section provided below at least a portion of the roof such that a services cavity is formed between the roof and the ceiling.

7. The prefabricated building module according to claim 6, comprising a front side wall, a rear side wall, a left end wall and a right end wall, wherein said front side, rear side, left end and right end walls are arranged in combination with the roof and the floor to form a generally rectangular prism, and wherein the at least one wall section is at least part of at least one of the front side, rear side, left end and right end walls.

8. The prefabricated building module of claim 7, further comprising at least one internal dividing wall for the prefabricated building module.

9. The prefabricated building module of claim 6, further comprising a services connector on an external side of the prefabricated building module, for providing at least one service incorporated in the services cavity to a location external to the prefabricated building module.

10. The prefabricated building module of claim 9, wherein the services connector is adapted to connect to a complementary connector in a wall structure to be fixed to the exterior of the prefabricated building module.

11. Parts for assembly of a building structure, the parts comprising:

a first plurality of stackable prefabricated building modules according to claim 1 for forming a first stack of prefabricated building modules;

a second plurality of stackable prefabricated building modules according to claim 1 for forming a second stack of prefabricated building modules;

components, different from the prefabricated building modules, for spanning a first distance between two said stacks of prefabricated building modules;

components, different from the prefabricated building modules, for spanning a second distance between two said stacks of prefabricated building modules, the second distance different from the first distance.

12. The parts for assembly of a building structure of claim 11, wherein said at least one elongated structural section of each prefabricated building module is at least one parallel flange channel (PFC) section provided in a recess formed in an outer surface of the at least one wall section of cross-laminated timber that is reinforced with at least one elongated structural section.

13. A building structure comprising a plurality of prefabricated building modules arranged so as to form a vertical stack, each prefabricated building module comprising:

at least one wall section of cross-laminated timber extending vertically between the upper and lower peripheral edges of the prefabricated building module, wherein a cross-laminated timber of the at least one wall section of cross-laminated timber extends vertically from the upper peripheral edge to the lower peripheral edge of the prefabricated building module, and wherein said at least one wall section of cross-laminated timber is reinforced with at least one elongated structural section extending vertically from the upper peripheral edges of the prefabricated building module to the lower peripheral edge of the prefabricated building module, so that one or more resulting columns of said cross-laminated timbers of a plurality of wall sections of cross-laminated timber and one or more resulting columns of said at least one elongated structural sections in the vertical stack act as a loadbearing structure for the building structure, and the at least one elongated structural section is a parallel flange channel (PFC) section.

14. The building structure of claim 13, wherein said at least one elongated structural section of each prefabricated building module is at least one parallel flange channel (PFC) section provided in a recess formed in an outer surface of the at least one wall section of cross-laminated timber that is reinforced with at least one elongated structural section.

15. The building structure of claim 14, wherein:

the building structure includes a plurality of said stacks; and the plurality of stacks provide primary stability for the building.

* * * * *